US009828172B2

(12) United States Patent
Skeid

(10) Patent No.: US 9,828,172 B2
(45) Date of Patent: Nov. 28, 2017

(54) INTERMODAL CONTAINER

(71) Applicant: Eirik Skeid, Fornebu (NO)

(72) Inventor: Eirik Skeid, Fornebu (NO)

( * ) Notice: Subject to any disclaimer, the term of this patent is extended or adjusted under 35 U.S.C. 154(b) by 160 days.

(21) Appl. No.: 13/974,231

(22) Filed: Aug. 23, 2013

(65) Prior Publication Data

US 2014/0190964 A1 Jul. 10, 2014

Related U.S. Application Data

(63) Continuation-in-part of application No. 13/735,732, filed on Jan. 7, 2013, now Pat. No. 9,038,838.

(51) Int. Cl.

| | |
|---|---|
| ***B65D 90/02*** | (2006.01) |
| ***B65D 90/08*** | (2006.01) |
| ***B65D 88/52*** | (2006.01) |
| ***B65D 6/32*** | (2006.01) |
| ***B65D 90/00*** | (2006.01) |
| ***B65D 90/20*** | (2006.01) |
| ***B65D 88/00*** | (2006.01) |
| ***B65D 88/12*** | (2006.01) |
| ***B65D 19/06*** | (2006.01) |
| ***B65D 19/08*** | (2006.01) |
| ***B65D 19/10*** | (2006.01) |

(52) U.S. Cl.

CPC ..... *B65D 88/12* (2013.01); *B65D 88/528* (2013.01); *B65D 90/00* (2013.01); *B65D 90/0006* (2013.01); *B65D 90/0066* (2013.01); *B65D 90/0073* (2013.01); *B65D 2590/0066* (2013.01)

(58) Field of Classification Search

CPC ..... B65D 2501/24165; B65D 2519/00024; B65D 2519/00652; B65D 7/38; B65D 88/12; B65D 90/02; B65D 90/08; B65D 88/528; B65D 90/0006; B65D 90/0066; B65D 2519/00273; B65D 2519/00293; B65D 2519/00323; B65D 2519/00786; B65D 19/06; B65D 19/08; B65D 19/10; B65D 88/129; B65D 90/006; B65D 90/20; B65D 90/0073; B65D 2590/0041

See application file for complete search history.

(56) References Cited

U.S. PATENT DOCUMENTS 3,157,423 A * 11/1964 Brie, Sr. ..... B65D 19/38 108/56.1
3,451,452 A * 6/1969 Marshall ..... B65D 90/02 220/646
3,654,877 A * 4/1972 Barrett ..... B65D 19/0095 108/56.1
D264,323 S * 5/1982 Nordstrom ..... D34/38
(Continued)

*Primary Examiner* — Andrew T Kirsch
(74) *Attorney, Agent, or Firm* — Michael A. Blake

(57) ABSTRACT

An intermodal container comprising: a first post; a first side panel attached to the first post; a second post, attached to the first side panel; a third post; a second side panel attached to the third post; a fourth post attached to the second side panel; a front panel attached to the first and fourth posts; a rear panel attached to the second and third posts; at least one shelf attached to the first, second, third, and fourth posts, and where the shelf can attach to the posts at a plurality of heights along the posts; the at least one shelf comprising: a front beam; a rear beam; a first strap bar extending from the front beam away from the shelf; and a second strap bar extending from the rear beam away from the shelf.

4 Claims, 34 Drawing Sheets

(56) References Cited

U.S. PATENT DOCUMENTS

| | | | | | |
|---|---|---|---|---|---|
| 5,626,231 | A * | 5/1997 | Kwong | B65D 19/14 | 108/54.1 |
| D402,037 | S * | 12/1998 | Hofstad | D34/38 | |
| 6,112,673 | A * | 9/2000 | Gomez | B65D 19/0028 | 108/51.11 |
| 6,164,476 | A * | 12/2000 | Rene | B65D 19/12 | 220/4.28 |
| D603,123 | S * | 10/2009 | Canters | D34/38 | |
| D609,425 | S * | 2/2010 | Svedberg | D34/38 | |
| 2004/0140305 | A1* | 7/2004 | Okumura | B65D 88/524 | 220/6 |
| 2008/0193247 | A1* | 8/2008 | Zupancich | B65D 19/10 | 410/92 |
| 2009/0065562 | A1* | 3/2009 | Xia | B65D 7/28 | 229/146 |
| 2013/0319887 | A1* | 12/2013 | Symonds | B65D 19/12 | 206/279 |
| 2014/0076755 | A1* | 3/2014 | Bradford | B65D 19/06 | 206/335 |
| 2014/0190963 | A1* | 7/2014 | Skeid | B65D 88/528 | 220/1.5 |
| 2014/0263379 | A1* | 9/2014 | Brennan, Jr. | B65D 90/08 | 220/720 |
| 2015/0034637 | A1* | 2/2015 | Durand | F16B 5/0072 | 220/4.21 |

* cited by examiner

INTERMODAL CONTAINER

CROSS-REFERENCES

This patent application is a continuation-in-part of patent application Ser. No. 13/735,732, by Eirik Smedsrud Skeid, entitled "INTERMODAL CONTAINER", filed on Jan. 7, 2013, the entire contents of which are fully incorporated by reference herein.

TECHNICAL FIELD

The invention relates to transport containers, and, more particularly, to intermodal transport containers that efficiently use the available space in a transportation means.

BACKGROUND

Currently in the transportation industry, wooden pallets are used to store material when shipping, and pallet racking systems are used when in storage. Because the wooden pallet has only a bottom and generally no sides, material to be transported is loaded on top of the pallet and secured using shrink wrap which is also a protection mechanism for the material. There is no known designed stacking mechanism for pallets so they are stacked only if the material loaded presents a flat enough surface to load another pallet on top it. The pallet racking systems are usually fixed inside of buildings and are not adjustable for load sizes.

In both instances described above it is not possible to maximize available space in the transportation means, such as a road, air, rail, and sea, and protect or secure the load fully.

Currently wood is used for blocking and bracing of loads inside of a shipping container. Based on the sizes and dimensions of pallets or other loaded items, wood is cut to size and placed to brace the internal load. This wood is cut to specific load configurations and usually cannot be used for the same application more than once so it is discarded when the shipping container is unloaded.

Other known intermodal containers do not provide shock dampening, self-centered stacking and maximizing of available space. Other known intermodal containers are generally very heavy which leads to problems in of itself.

Thus there is a need for an intermodal container that overcomes the above listed and other disadvantages.

SUMMARY OF THE INVENTION

The disclosed invention relates to an intermodal container comprising: a first post; a first side panel attached to the first post; a second post, attached to the first side panel; a third post; a second side panel attached to the third post; a fourth post attached to the second side panel; a front panel attached to the first and fourth posts; a rear panel attached to the second and third posts; at least one shelf attached to the first, second, third, and fourth posts, and where the shelf can attach to the posts at a plurality of heights along the posts; a front floor beam attached to the first and fourth posts; a rear floor beam attached to the second and third posts; at least one cross beam attached to the front floor beam and rear floor beam; a first floor beam notch located on the front floor beam and generally collinear with the cross beam; a first cross beam notch located on the cross beam, the first cross beam notch generally located on the front floor beam end of the cross beam, and generally collinear with the cross beam; a first cut-out located in the cross beam, the first cut-out forming a first gap located between the cross beam and the front floor beam; a first bar attached to the first floor beam notch and the first cross beam notch, and traversing the first gap; a second floor beam notch located on the rear floor beam and generally collinear with the cross beam; a second cross beam notch located on the cross beam, the second cross beam notch generally located on the rear floor beam end of the cross beam, and generally collinear with the cross beam; a second cut-out located in the cross beam, the cut-out forming a second gap located between the cross beam and the rear floor beam; a second bar attached to the second floor beam notch and the second cross beam notch, and traversing the second gap; where the first gap is configured to allow a strap to slide through the first gap and wrap around the first bar and is further configured to allow a hook to slide through the first gap and hook onto the first bar; and where the second gap is configured to allow a strap to slide through the second gap and wrap around the second bar and is further configured to allow a hook to slide through the second gap and hook onto the second bar.

The invention also relates to an intermodal container comprising: a first post; a first side panel attached to the first post; a second post, attached to the first side panel; a third post; a second side panel attached to the third post; a fourth post attached to the second side panel; a front panel attached to the first and fourth posts; a rear panel attached to the second and third posts; at least one shelf attached to the first, second, third, and fourth posts, and where the shelf can attach to the posts at a plurality of heights along the posts; a first side floor beam attached to the first and second posts; a second side floor beam attached to the third and fourth posts; at least one longitudinal cross beam attached to the first side floor beam and second side floor beam; a first side floor beam notch located on the first side floor beam and generally collinear with the longitudinal cross beam; a first longitudinal cross beam notch located on the longitudinal cross beam, the first longitudinal cross beam notch generally located on the first side floor beam end of the longitudinal cross beam, and generally collinear with the longitudinal cross beam; a first cut-out located in the longitudinal cross beam, the first cut-out forming a first gap located between the longitudinal cross beam and the first side floor beam; a first bar attached to the first side floor beam notch and the first longitudinal cross beam notch, and traversing the first gap; a second side floor beam notch located on the second side floor beam and generally collinear with the longitudinal cross beam; a second longitudinal cross beam notch located on the longitudinal cross beam, the second longitudinal cross beam notch generally located on the second side floor beam end of the longitudinal cross beam, and generally collinear with the longitudinal cross beam; a second cut-out located in the longitudinal cross beam, the cut-out forming a second gap located between the longitudinal cross beam and the second side floor beam; a second bar attached to the second floor beam notch and the second cross beam notch, and traversing the second gap; where the first gap is configured to allow a strap to slide through the first gap and wrap around the first bar and is further configured to allow a hook to slide through the first gap and hook onto the first bar; and where the second gap is configured to allow a strap to slide through the second gap and wrap around the second bar and is further configured to allow a hook to slide through the second gap and hook onto the second bar.

In addition, the invention relates to an intermodal container comprising: a first post; a first side panel attached to the first post; a second post, attached to the first side panel; a third post; a second side panel attached to the third post;

a fourth post attached to the second side panel; a front panel attached to the first and fourth posts; a rear panel attached to the second and third posts; at least one shelf attached to the first, second, third, and fourth posts, and where the shelf can attach to the posts at a plurality of heights along the posts; the at least one shelf comprising: a front beam; a rear beam; a first strap bar extending from the front beam away from the shelf; and a second strap bar extending from the rear beam away from the shelf.

Additionally, the invention relates to an intermodal container comprising: a first post; a first side panel attached to the first post; a second post, attached to the first side panel; a third post; a second side panel attached to the third post; a fourth post attached to the second side panel; a front panel attached to the first and fourth posts; a rear panel attached to the second and third posts; a first post top side hole located at the top of the first post; a first post top center hole located at the top of the first post and adjacent to the first post top side hole; a first post top front hole located at the top of the first post and adjacent to the first post top center hole; a first post bottom side hole located at the bottom of the first post; a first post bottom center hole located at the bottom of the first post and adjacent to the first post bottom side hole; a first post bottom front hole located at the bottom of the first post and adjacent to the first post bottom center hole; and where each of the side holes, center holes, and front holes are configured to be large enough to accept a cargo strap or a means for locking two adjacent intermodal containers together.

The invention also relates to an intermodal container comprising: a first post; a first side panel attached to the first post; a second post, attached to the first side panel; a third post; a second side panel attached to the third post; a fourth post attached to the second side panel; a front panel attached to the first and fourth posts; a rear panel attached to the second and third posts; at least one shelf attached to the first, second, third, and fourth posts, and where the shelf can attach to the posts at a plurality of heights along the posts, the at least one shelf comprising: a grid; a front beam attached to the underside of the grid; a first side beam attached to the underside of the grid and to the front beam at generally a right angle to the front beam; a second side beam attached to the underside of the grid and to the front beam at generally a right angle to the front beam; a rear beam attached to the underside to the grid and to the first and second side beams, at generally right angles to the first and second side beams; a liquid barrier plate attached to the front, first side, second side and rear beams, and located generally under the grid; a drain hole located in the rear beam or front beam, the drain hole configured to drain liquid collected on the liquid barrier plate and direct the liquid down the first side panel or the second side panel.

Also, the invention relates to an intermodal container comprising: a first post; a first side panel attached to the first post; a second post, attached to the first side panel; a third post; a second side panel attached to the third post; a fourth post attached to the second side panel; a front panel attached to the first and fourth posts; a rear panel attached to the second and third posts; a first bottom support member attached to the first and second posts, and located generally at the bottom of the intermodal container, the first bottom support member comprising: a first slot; a second bottom support member attached to the third and fourth posts, and located generally at the bottom of the intermodal container, the second bottom support member comprising: a second slot; at least one shelf attached to the first, second, third, and fourth posts, and where the shelf can attach to the posts at a plurality of heights along the posts; the first side panel comprising: a top beam attached to the first and second posts, and located generally at the top of the intermodal container; a first sliding bar slideably attached to the top beam, the first sliding bar slideable in generally a vertical direction, the first sliding bar generally parallel with the first post, the first sliding bar having a pin hole located generally near the top of the first sliding bar; the second side panel comprising: a top beam attached to the third and fourth posts, and located generally at the top of the intermodal container; a second sliding bar slideably attached to the top beam, the second sliding bar slideable in generally a vertical direction, the second sliding bar generally parallel with the third post, the second sliding bar having a pin hole located generally near the top of the second sliding bar; where the first sliding bar is configured to slide into a first slot of a second intermodal container stacked on the first intermodal container, and the first sliding bar is configured to be locked in place with a pin that is configured to slide through the pin hole in the first sliding bar; and where the second sliding bar is configured to slide into a second slot of a second intermodal container stacked on the first intermodal container, and the second sliding bar is configured to be locked in place with a pin that is configured to slide through the pin hole in the second sliding bar.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
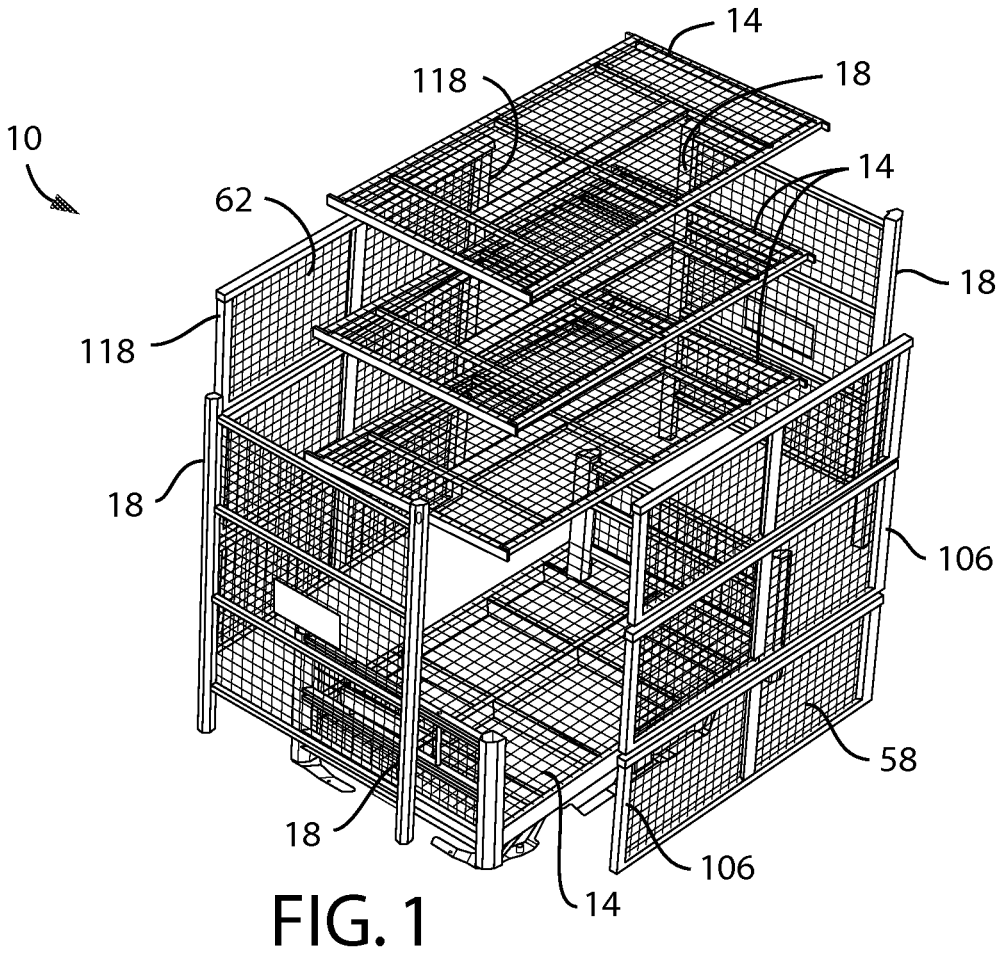
FIG. 1 is an exploded view of one embodiment of the disclosed intermodal container.

The disclosed intermodal container may be an industrial strength container designed to protect and secure material during storage and transportation while generally maximizing the available space in shipping assets for road, rail, air and sea. Additional space saving may be achieved while in storage since the disclosed intermodal container is generally stackable when loaded with material and generally collapsible to a generally flat configuration when empty.

A known problem associated with shipping material is maximizing the available space in different shipping modes. The disclosed intermodal container solves this problem by not only generally maximizing space in one type of shipping mode but also being transferable to a different mode and also maximizing that space as well, i.e. the intermodal container may occupy about 90% of the space available in a 20 foot ISO container for shipping by sea and then be transferred to an air pallet where it may occupy about 99% of the space allowed without having to change the configuration.

A second known problem associated with shipping material is protecting the material loaded inside the container. Most material is damaged during movement by the vibration of the load and motion of the material within the space it has occupied. The disclosed intermodal container has adjustable shelves and divider walls to limit the space where material is loaded and can moved due to vibration and motion of transportation. The disclosed intermodal container minimizes vibration through a shock dampening design that has been incorporated into the base of the disclosed intermodal container to reduce impact shock on the material loaded inside the disclosed intermodal container.

Another problem associated with shipping material is how to block and brace loads for ship movement. When moving material by ship the loads have to be braced preventing movement caused by momentum when traveling in water. The disclosed intermodal container may have an integrated blocking and bracing system.

Keeping the material secure is another issue. One or more design elements of the disclosed intermodal container make it impossible to access the material being transported when assembled without removing the front panels. The front panels may be secured in place with a lock in a slide bar that engages the end wall of the disclosed intermodal container.

Other issues the disclosed intermodal container can solve include the ability to carry heavy loads while maintaining a light TARE weight. The disclosed intermodal container may use unique steel and design elements to accomplish this light TARE weight. In one embodiment, the steel may be a hot roll cold (HRCF) form steel which is high strength low alloy (HSLA); the commercial name is "DOMEX" and it is a commercial product supplied by Swedish Steel. Contact information for Swedish Steel is: SSAB AB, Klarabergsviadukten 70, D6, P.O Box 70; 101 21 Stockholm SWEDEN, Telephone: +46 8 45 45 700. The properties of Domex allow the use smaller/thinner steel with the same strength qualities as thicker standard steel. This keeps the TARE weight low and the strength high. The design elements such as bends in the steel, location of reinforcing elements, and type of steel allow for lighter materials to be used while still maintaining strength capabilities. The disclosed intermodal container also comprise design elements that make the process of stacking these containers safer by minimizing the risk of falling due to the design elements that center the disclosed intermodal containers when stacked on top of each other. The self-centering aspect of the design reduces the risk of items being stacked improperly and falling. The disclosed intermodal container also comprises bends in the corner post which allow for greater internal space which allows more material to be loaded in the disclosed intermodal container.

To solve the problem of maximizing available space, the disclosed intermodal container has been designed with dimensions in the multiple configurations around the available dimensions on transportation assets.

To solve the problem of protecting the material and equipment being transported, the disclosed intermodal container comprise adjustable shelving which can be adjusted to the sizes of the material package reducing the space around it for ancillary movement during transportation. Furthermore, for protection of material the disclosed intermodal container comprises design elements that serve as a form of shock absorbing/dampening by using a series of bends and angles incorporated into the base which reduces vibration that could damage material.

An additional element that may be incorporated into the disclosed intermodal containers are blocking and bracing mechanisms. These blocking and bracing mechanisms allow the disclosed intermodal container to be braced inside a shipping container, so that movement inside of that disclosed intermodal container which normally causes momentum which could damage material or damage the shipping container itself. The addition of blocking and bracing also provides an element where these disclosed intermodal container could also be secured to the floor if desired. In embodiments without integrated blocking and bracing, the maximizing of space reduces the amount of blocking and bracing if needed.

To reduce the overall weight of the disclosed intermodal container, the container comprises bends into elements such as corner posts to create greater strength allowing us to use lighter materials in manufacturing. In many instances there are weight limits to loads so by reducing the weight of the container while it is empty yet maintaining high strength standards it allows for more of the weight be applied to the limits from the material and not the container.

For security of the materials being shipped, the disclosed intermodal container comprises tabs and slides that prevent access inside of the container when assembled and lock. There is generally no way to get into these containers, short of using metal cutting tools, without removing the front panels.

The disclosed intermodal container has generally incorporated all of the problem solving design elements into the disclosed intermodal container itself, there is no need for additional equipment or material to solve the problems. There is no requirement for tools to assemble, disassemble or operate using our device. There is no known system that incorporates shock dampening or self centering corners for stacking in the market place.

The disclosed intermodal container is the lightest device available with the strength capabilities it possesses and this was achieved by the design elements we have incorporated to reduce the material weight for manufacturing.

The disclosed intermodal container may be made using hot rolled cold formed steel and steel mesh. Assembly parts may be laser cut to tolerance and then bent using a press break to drawing specifications. Parts may be welded together in accordance with production drawings and then hot-dip galvanized for protection from corrosion. Final assembly includes attaching hardware items and data plates. The disclosed intermodal container may then be flat-packed for delivery to the user.

FIG. 1 shows an exploded view of one embodiment of the disclosed intermodal container 10. The disclosed intermodal container comprises shelves 14 and posts 18. The version pictured has single long shelves 14 that are adjustable up and down. Another embodiment of the disclosed intermodal container has a split shelf version which has shelves that are generally about half the size of shelves 14 and adjustable up and down as well. The split shelves may be arranged in the disclosed intermodal container through the addition of a shelf support and also include divider walls. A front panel 58 may comprise two or more front panel supports 106. A rear panel 62 may also comprise two or more rear panel supports 118.

Figure 2:
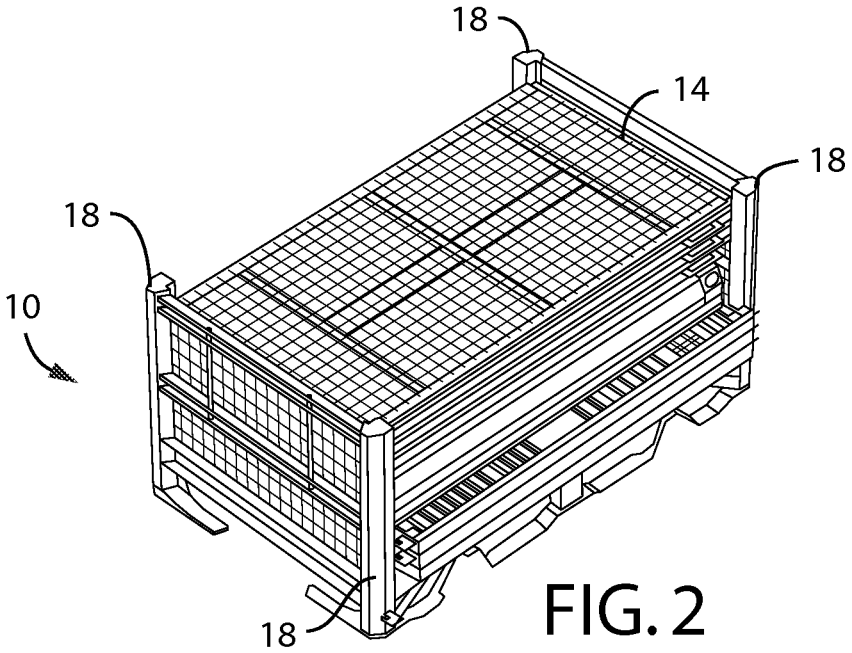
FIG. 2 is a view of the disclosed intermodal container from FIG. 1, but in a flat-packed configuration.

FIG. 2 shows a view of the disclosed intermodal container 10 from FIG. 1, but in a flat-packed configuration so that it can be transported in a small volume. The volume may be about 25%-30% of what an assembled item is. When flat-packed the intermodal containers are stackable with like items.

Figure 3:
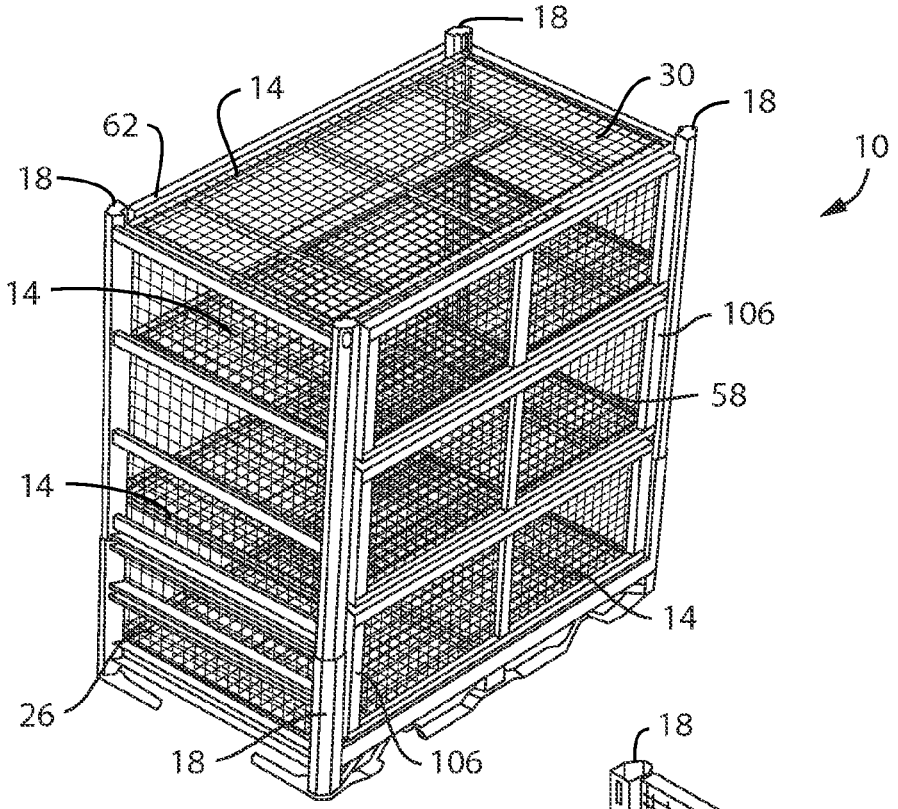
FIG. 3 is a view of the disclosed intermodal container in one assembled configuration.

FIG. 3 shows a view of the disclosed intermodal container 10 in one assembled configuration.

Figure 4:
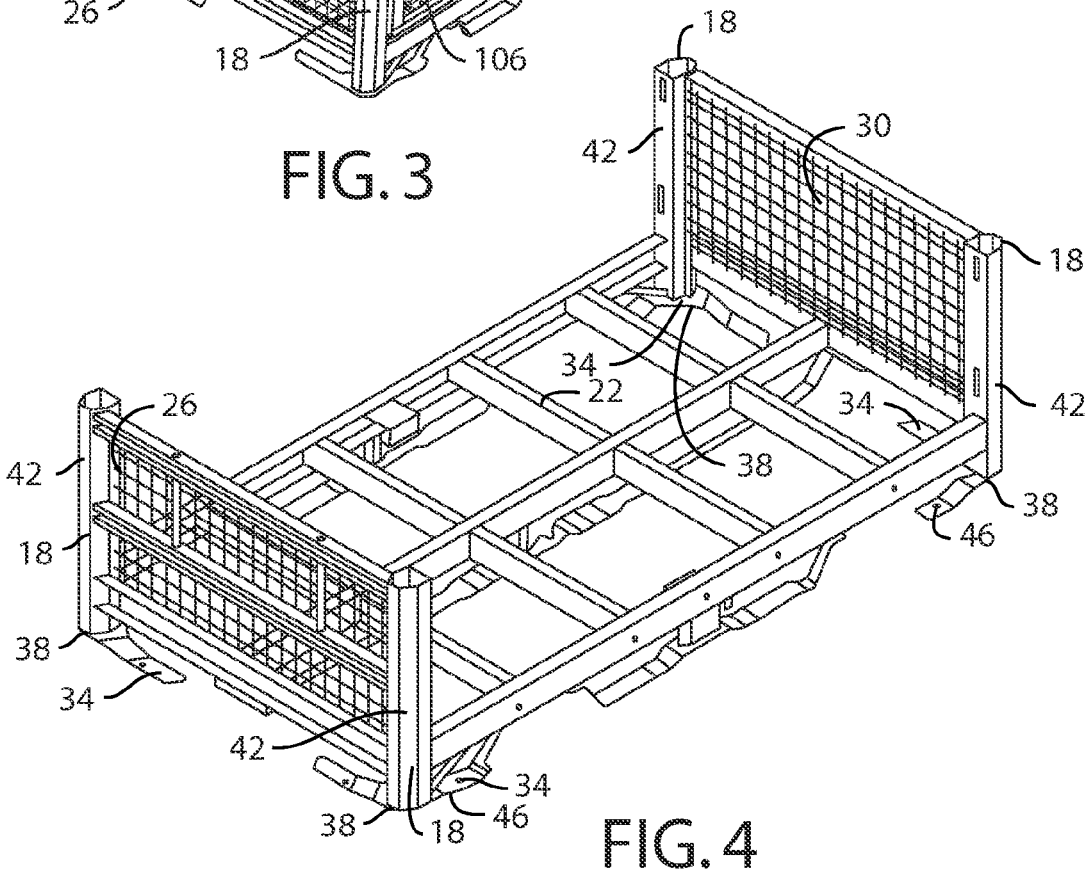
FIG. 4 is perspective view of the intermodal container showing some of the design elements.

FIG. 4 shows some of the design elements in the disclosed intermodal container 10. Only a portion of the intermodal container is shown in FIG. 4. The base 22 in communication with a first side panel 26 and a second side panel 30 are shown. The shock dampening design elements 34, self-centering corners 38, space optimizing corners posts 42, and blocking and bracing elements 46 are shown in this figure. Features 34, 38, 42, and 46 will be discussed in more detail below.

Figure 6:
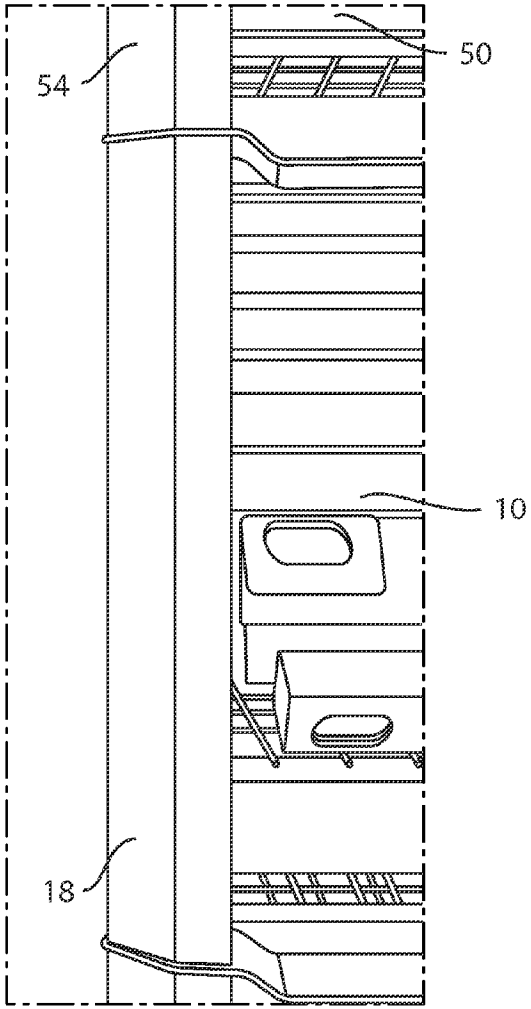
FIG. 6 is a close up view of the left corner post of a bottom intermodal container with a another intermodal container stacked on top of it.
Figure 5:
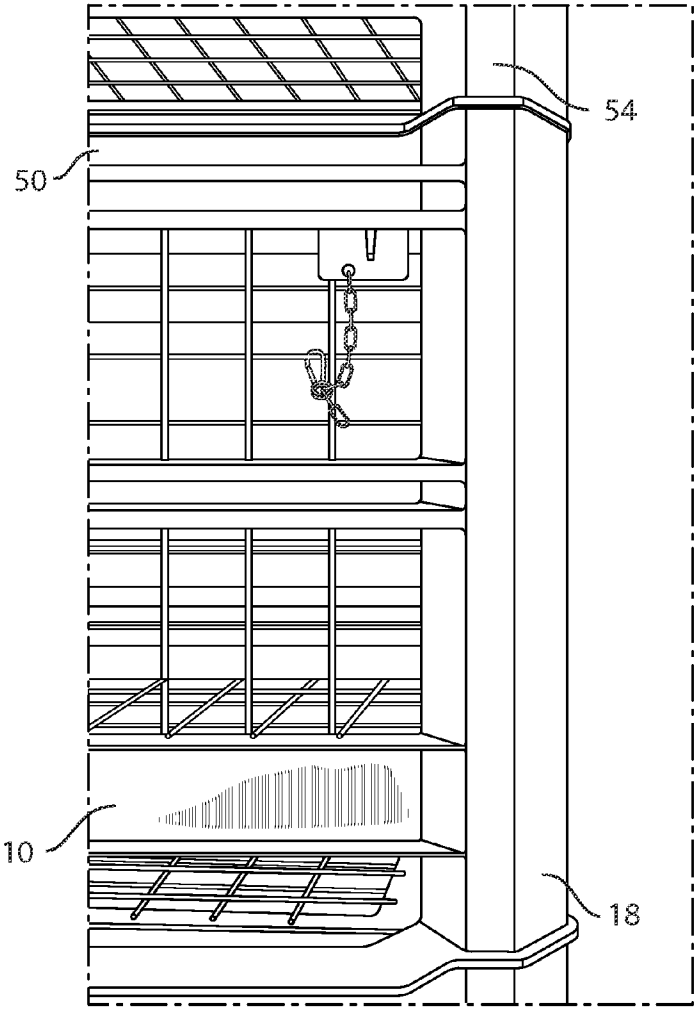
FIG. 5 is a close up view of the right corner post of a bottom intermodal container with another intermodal container stacked on top of it.

FIG. 5 shows a close up view of the right corner post 18 of a bottom intermodal container 10 with a top intermodal container 50 stacked on the bottom intermodal container 10. The corner post 18 of the bottom container 10 is shown lined up and stacked inside the corner post 54 of the top container 50. The cross-sectional shape of the corner posts 18 and 54 are generally convex polygons that match to each other. Due to the angles of the cross-sectional polygon shape of the posts 18, 54, when one stacks a top container 50 onto a bottom container 10, each pair of stacking posts 18, 54 will self-center, and force the containers 10, 50 to properly align in a safe stacked configuration. FIG. 6 is a close up view of the left corner post 18 of a bottom intermodal container 10 with a top intermodal container 50 stacked on the bottom intermodal container 10

Figure 7:
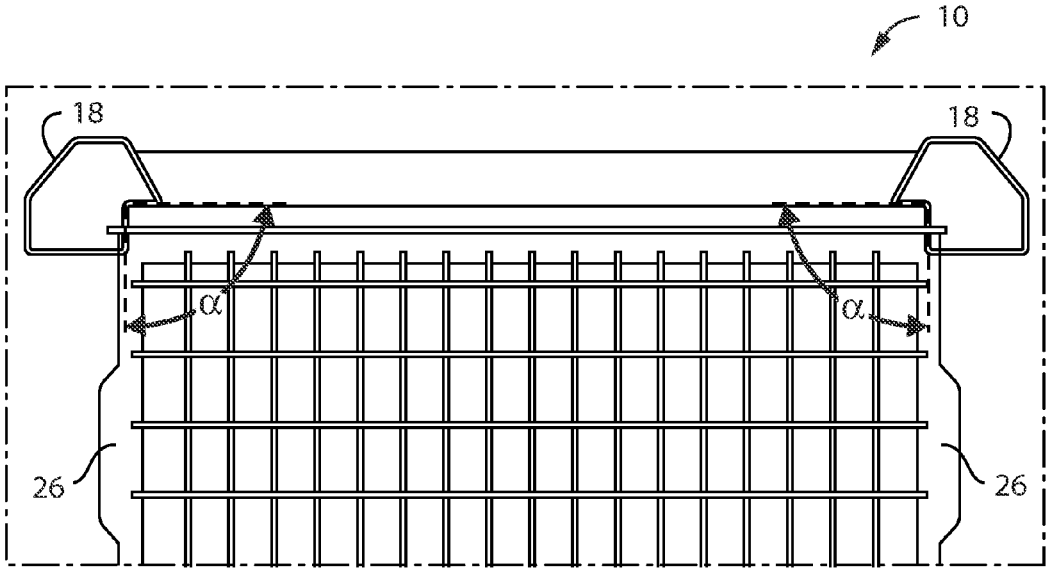
FIG. 7 is a close up top view of the rear corner posts of the disclosed intermodal container.
Figure 8:
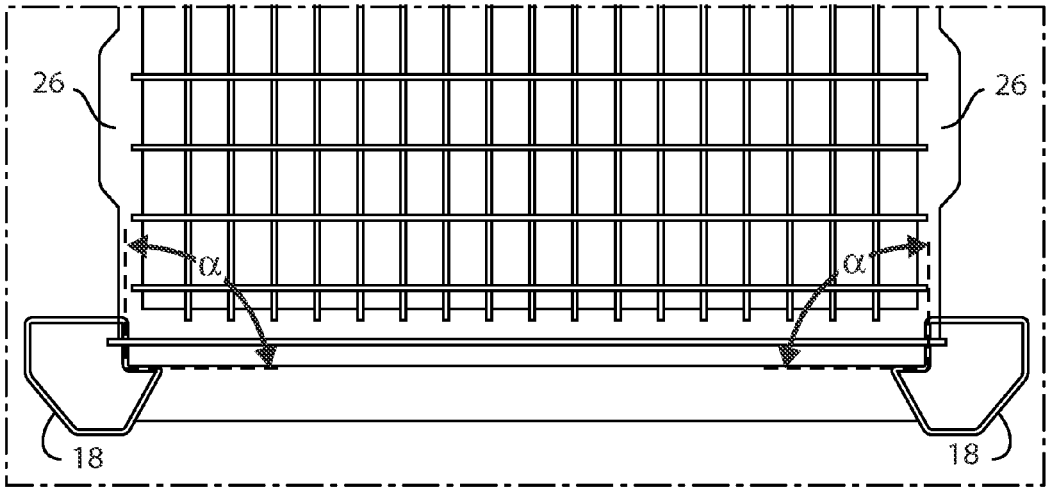
FIG. 8 is a close up top view of the front corners posts of the disclosed intermodal container.

FIG. 7 is a close up top view of the rear corners posts 18 of the disclosed intermodal container 10. In this view you can see the cross-sectional convex polygon shape of the posts 18, which allow for self-centering of disclosed intermodal containers. Further, the cross-sectional shape of the posts 18 has an angle $\alpha$ that is generally a right angle configured to maximize the space available on the disclosed intermodal container 10, in other words the angle $\alpha$ is oriented on the post 18 such that the post will generally not be in the way of the material being transported in the disclosed intermodal container. FIG. 8 is a close up top view of the front corners posts 18 of the disclosed intermodal container 10. In this view you can see the cross-sectional convex polygon shape of the posts 18, which allow for self-centering of disclosed intermodal containers. Further, the cross-sectional shape of the posts 18 has an angle $\alpha$ that is generally a right angle configured to maximize the space available on the disclosed intermodal container 10, in other words the angle $\alpha$ is oriented on the post 18 such that the post will generally not be in the way of the material being transported in the disclosed intermodal container.

Figure 9:
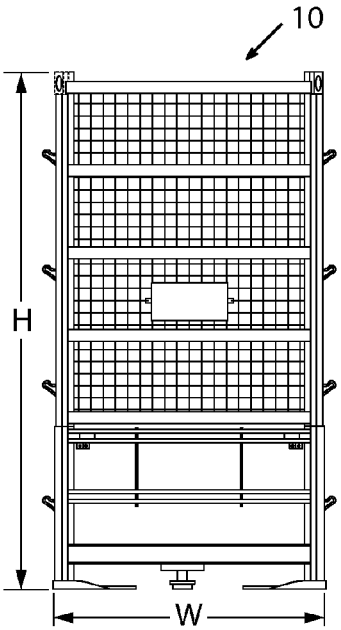
FIG. 9 is a side view of one embodiment of the disclosed intermodal container.
Figure 10:
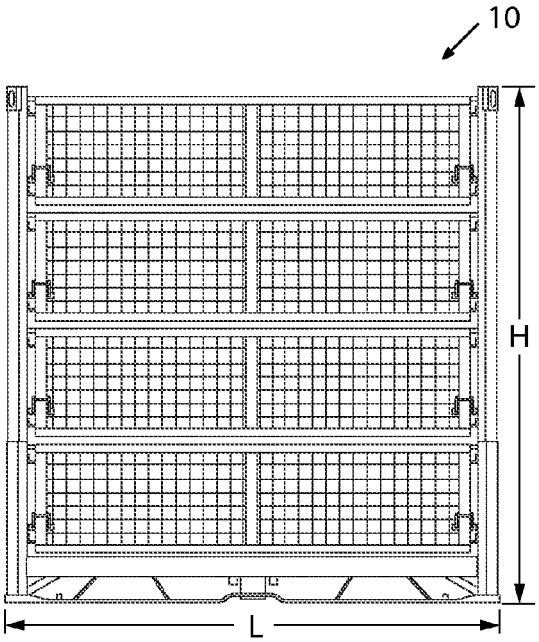
FIG. 10 is a front view of one embodiment of the disclosed intermodal container.

FIG. 9 is a side view of one embodiment of the disclosed intermodal container 10. FIG. 10 is a front view of one embodiment of the disclosed intermodal container 10. The intermodal container 10 has a width W, height H, and length L as shown. The dimensions of the disclosed intermodal container 10 have been designed to maximize available space inside various shipping means. Table 1 below shows the available space in different types of shipping platforms. This is the internal available space. Keep in mind that the door opening is smaller than the interior so it is impossible to get 100% fill using items to store large equipment. The percentage fills vary between the different shipping platforms to demonstrate the flexibility of the item between them. Although items above were listed as N/A does not mean the item won't fit in them just that they were not designed for them so % fill is not factored in. The goal was to get the best size that fits into as many platforms as possible while still meeting requirements.

TABLE 1

| Shipping Platform | Internal Width | Internal Length | Internal/ Door Height | CF |
|---|---|---|---|---|
| 40' Standard | 92" | 473" | 90" | 2266 |
| 40' High Cube | 92" | 473" | 96" | 2543 |
| 20' Standard | 92" | 231" | 90" | 1095 |
| 463 Air Pallet | 84" | 104" | 88" (60" Airdrop) | 445 |

TABLE 1-continued

| Shipping Platform | Internal Width | Internal Length | Internal/ Door Height | CF |
|---|---|---|---|---|
| TRICON Container | 77" | 92" | 80" | 340 |
| QUADCON Container | 53" | 90" | 70" | 193 |
| ISU-90 Container (2-sides) | 39" | 102" | 84" | 387 |

Table 2 shows the models of disclosed intermodal container that incorporate the disclosed improvements and it also shows the type of shipping means they may be used for.

TABLE 2

| SharkCage Model | Width | Length | Height | CF |
|---|---|---|---|---|
| ISO20 XL (20', 40') | 44" | 110" | 85" | 238 |
| ISO20 XL Divided (20', 40') | 44" | 110" | 85" | 238 |
| QUADCON (20', 40', 463) | 42" | 52" | 68" | 86 |
| ISU-90 | 38" | 92" | 78" | 158 |
| ISU-90 Divided | 38" | 92" | 78" | 158 |
| ISU-90 Small | 38" | 44" | 78" | 75 |
| ISO20 Large (20', 40', 463) | 46" | 84" | 88" | 197 |
| ISO20 Large Divided (20', 40', 463) | 46" | 84" | 88" | 197 |
| ISO20 Medium (20', 40', 463) | 46" | 84" | 60" | 134 |
| ISO20 Medium Divided (20', 40', 463) | 46" | 84" | 60" | 134 |
| Secondary Load | 45" | 78" | 60" | 125 |
| Secondary Load Divided | 45" | 78" | 60" | 125 |
| ISO20 Small (20', 40', 463) | 46" | 84" | 44" | 98 |
| ISO20 Small Divided (20', 40', 463) | 46" | 84" | 44" | 98 |
| ISO20 XS(20', 40', 463) | 46" | 84" | 28" | 63 |
| ISO20 XS Divided (20', 40', 463) | 46" | 84" | 28" | 63 |
| Warehouse | | | | |
| Warehouse Divided | | | | |
| TRICON | 42" | 70" | 78" | 133 |
| TRICON Divided | 42" | 70" | 78" | 133 |
| W (20', 40') | 45" | 89" | 44" | 102 |
| Bike Track | 52" | 84" | 88" | 222 |
| Bike Track Divided | 52" | 84" | 88" | 222 |

Table 3 shows the quantity and percentage (%) fill of each model of the disclosed intermodal container in the applicable shipping means and how each intermodal container maximize the space used in the shipping means. A certain amount of space left over is necessary for maneuvering loads and uneven ground.

TABLE 3

| | QTY | 20' | 40' | TRI | QUAD | ISU-90 | 463L |
|---|---|---|---|---|---|---|---|
| CL/CS | 4 | 87% | N/A | N/A | N/A | N/A | N/A |
| | 8 | | 84% | N/A | N/A | N/A | N/A |
| I | 8 | 63% | 68% | N/A | 89% | N/A | 77% |
| ISLL/ISLS | 2 | N/A | N/A | N/A | N/A | 82% | N/A |
| ISS | 4 | N/A | N/A | N/A | N/A | 78% | N/A |
| M4L/M4S | 5 | 90% | | N/A | N/A | N/A | |
| | 10 | | 87% | N/A | N/A | N/A | |
| | 2 | | | N/A | N/A | N/A | 88% |
| M3L/M3S | 5 | 61% | | N/A | N/A | N/A | |
| | 10 | | 59% | N/A | N/A | N/A | |
| | 2 | | | N/A | N/A | N/A | 90%* |
| M2L/M2S | 10 | 90% | | N/A | N/A | N/A | |
| | 20 | | 87% | N/A | N/A | N/A | |
| | 4 | | | N/A | N/A | N/A | 88% |
| M1L/M1S | 15 | 86% | | N/A | N/A | N/A | |
| | 30 | | 83% | N/A | N/A | N/A | |
| | 6 | | | N/A | N/A | N/A | 84% |

TABLE 3-continued

| | QTY | 20' | 40' | TRI | QUAD | ISU-90 | 463L |
|---|---|---|---|---|---|---|---|
| TL/TS | 6 | 73% | | | N/A | N/A | |
| | 12 | | 70% | | N/A | N/A | |
| | 2 | | | 78% | N/A | N/A | 60% |
| W | 10 | 93% | | N/A | N/A | N/A | N/A |
| | 20 | | 90% | N/A | N/A | N/A | N/A |
| BTL/BTS | 2 | 81% | 82% | N/A | N/A | N/A | 100% |

Figure 11:
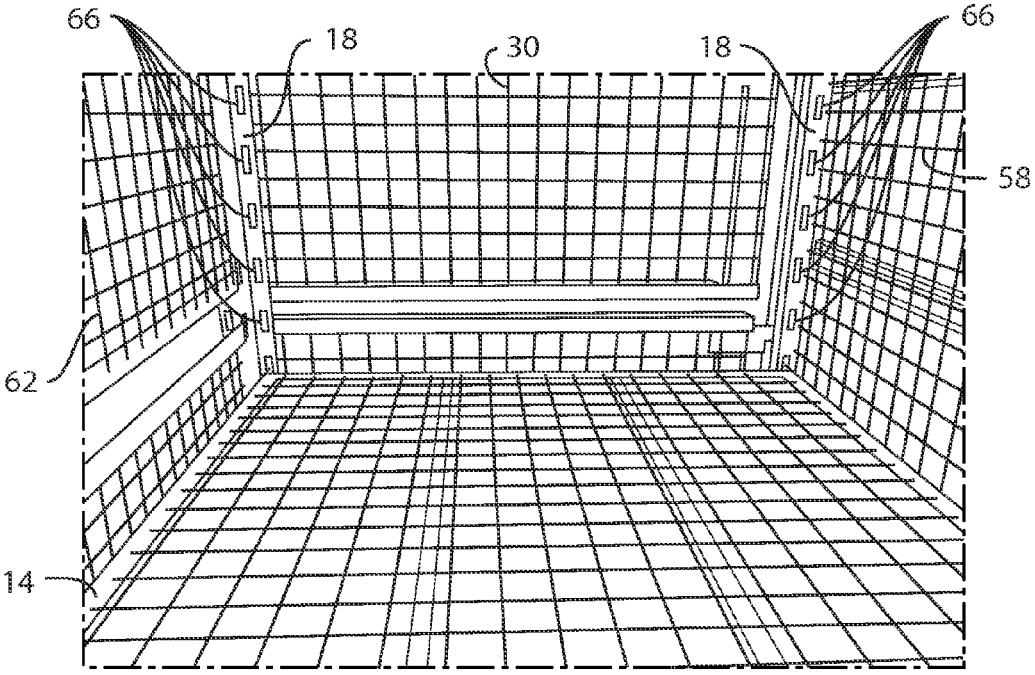
FIG. 11 is a view of the interior of a disclosed intermodal container.

*Designed for Airdrop Operations so available space is 60" in height for those operations FIG. 11 shows the interior of a disclosed intermodal container 10. A shelf 14 is shown adjacent to the second side panel 30, and a front panel 58 and a rear panel 62. The shelf height can be adjusted due to connection means in the posts 18. In one embodiment, the connection means may be slots 66 that are configured to accept tabs located on the shelves 14. Adjustable shelving allows for accommodating different sized materials reducing free space when transporting. The shelves 14 can be moved up and down into different positions.

Figure 12:
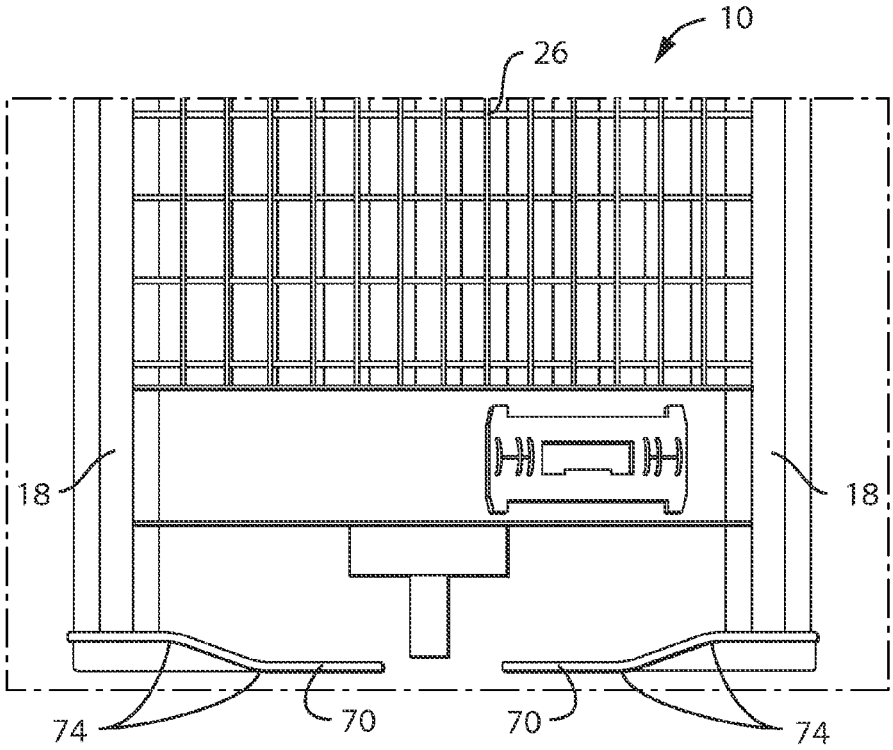
FIG. 12 is a close up view of the side support members.
Figure 13:
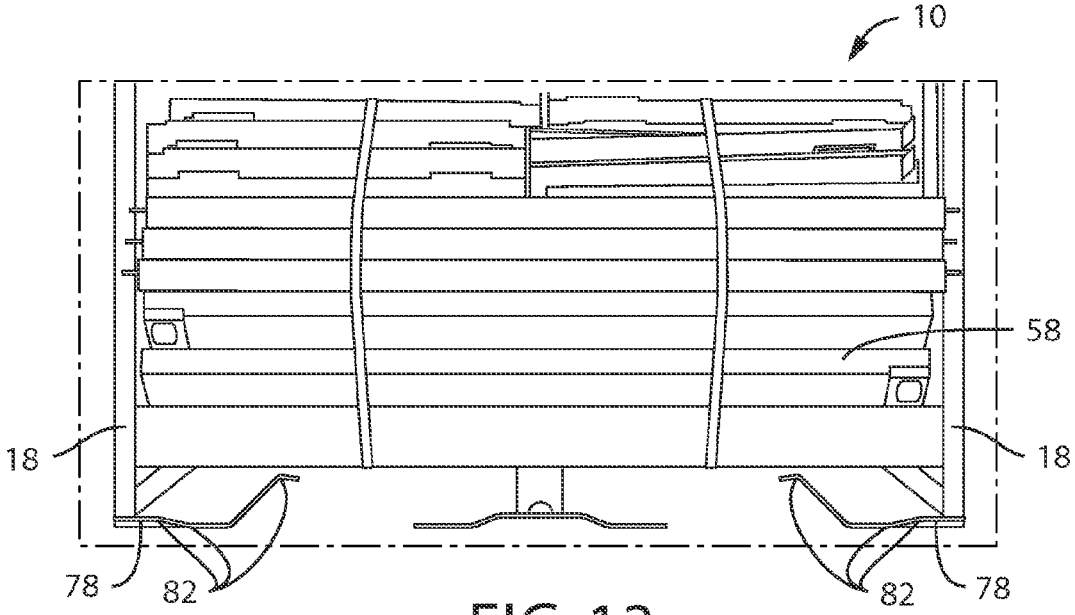
FIG. 13 is a close up view of the front support members.

FIG. 12 shows a close up view of the side support members 70 of the disclosed intermodal container 10. The side support members 70 may be in communication with the posts 18. The side support members 70 generally support the intermodal container 10 and may rest on the ground or surface where the container 10 is located. The side support member 70 extends generally from the post 18 to the post 18 on the opposite side of the container 10. The member 70 may have one or more bends 74. The member 70 with the bends 74 may act as very stiff springs that can provide shock dampening effects and reduce vibration protecting the material being transported from damage. The bends 74 may be generally obtuse angles, but may also form acute angles depending on the geometry. FIG. 13 shows a close up view of the front support members 78. The front support members 78 generally support the intermodal container 10 and may rest on the ground or surface where the container 10 is located. The front support member 78 extends generally from the post 18 towards a post 18 on the opposite side of the container. The member 78 may have one or more bends 82. The member 78 with the bends 82 may act as very stiff springs that can provide shock dampening effects and reduce vibration protecting the material being transported from damage. The bends 82 may be generally obtuse angles, but may also form acute angles depending on the geometry.

Figure 14:
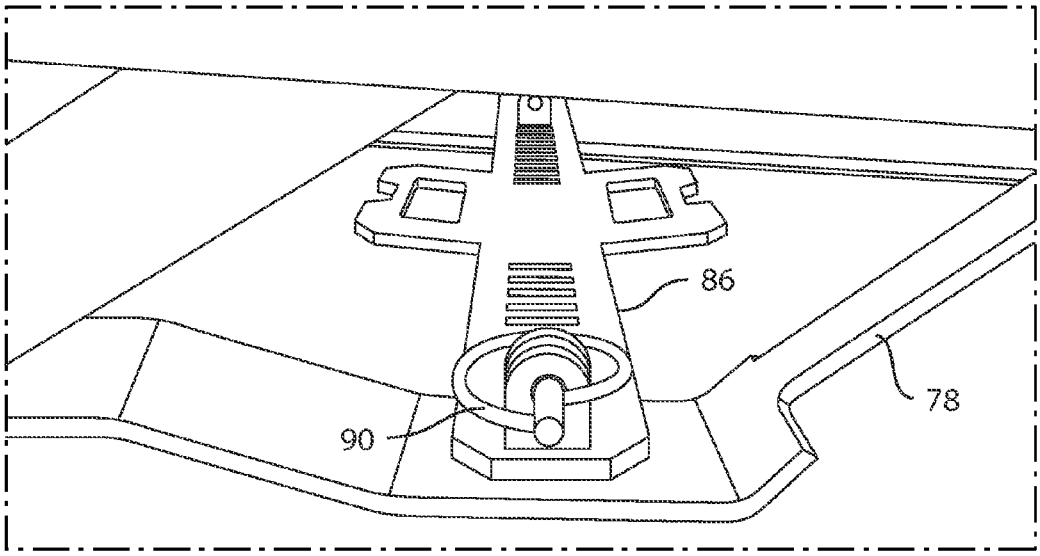
FIG. 14 shows the blocking and bracing member attached to a front support member.

Blocking and bracing material has been integrated into the intermodal container 10. Blocking and bracing materials are used for stabilizing the load while being transported in shipping containers. The integral blocking and bracing material eliminates the need for wood or separate blocking and bracing materials. Blocking and bracing can be configured to force the items being transported against the outside walls of the intermodal containers, thus stabilizing the items during movement. The blocking and bracing members may be integrated into the container 10 at both the bottom and top. In the bottom, as shown in FIG. 14, a blocking and bracing member 86 is attached to one or more front support members 78. The blocking and bracing member 86 may be removably attached to the front support members 78 using any suitable fasteners including but not limited to cotter pins and locking pins 90 The blocking and bracing member 86 can thus be stored generally under the container 10 while not in use and moved into position when necessary. On top they are stored inside the top horizontal bracing bar on the end wall and telescoped out when necessary, see FIGS. 18-23.

Figure 43:
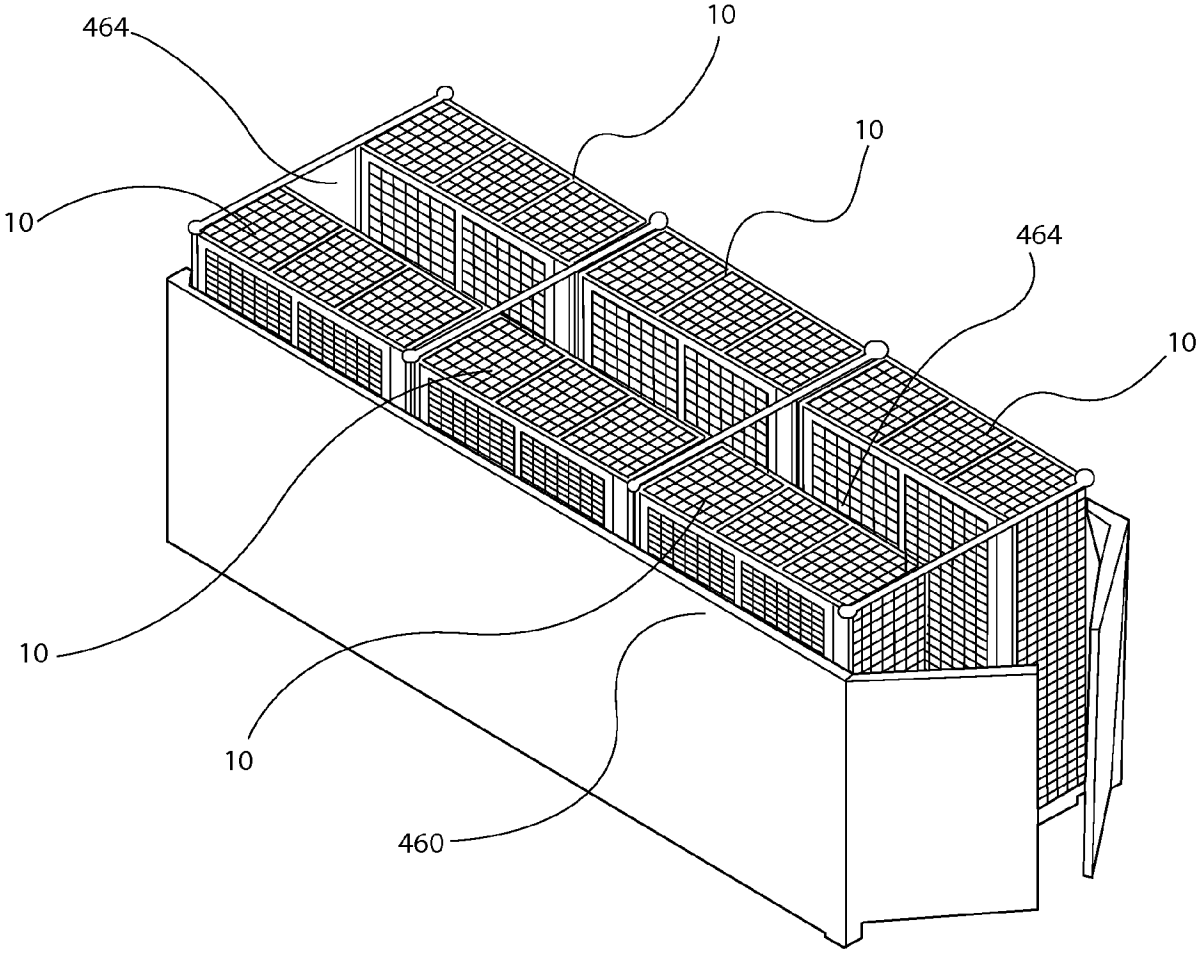
FIG. 43 is a perspective view of a cargo container with several intermodal containers located inside of the cargo container.

The blocking and bracing mechanisms also allows users to create one or more corridors 464 or access tunnels between intermodal containers in located in a cargo container. FIG. 43 shows a cargo container 460 with six intermodal containers 10 located inside of it (the top of the cargo container has been removed in this view so one can see the interior). Thus a person can walk safely into a container for whatever reason, even if the container is moving, because there are corridors 464 for the person to walk through, and the intermodal containers are blocked and braced in place, and will not move or shift even in transit.

Figure 15:
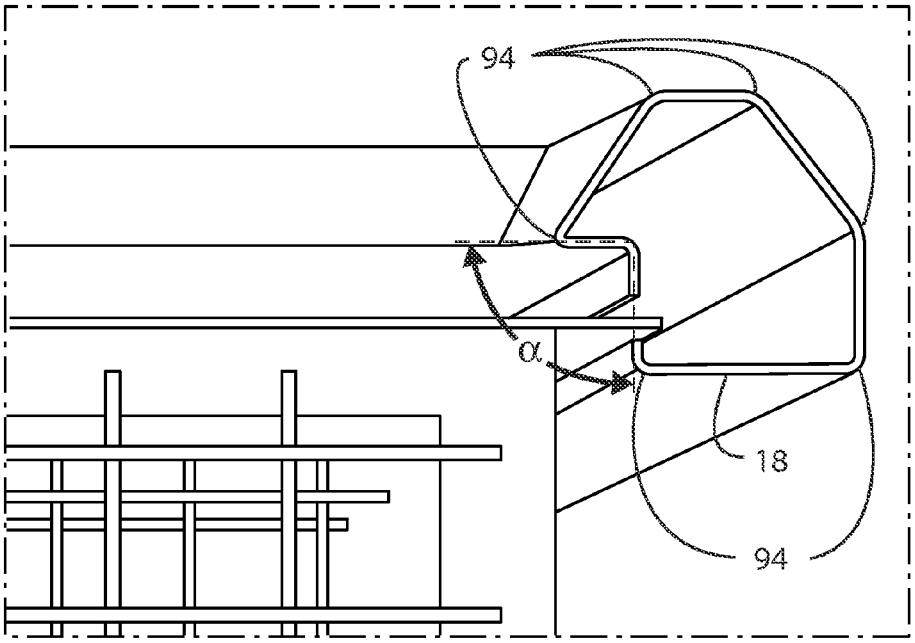
FIG. 15 is a top view that shows a cross-section of a post.

FIG. 15 is a top view that shows a cross-section of a post 18. To reduce the overall weight of the disclosed intermodal container 10, bends 94 have been designed into the corner posts to create greater strength allowing the use of lighter materials for the disclosed intermodal container 10.

Figure 16:
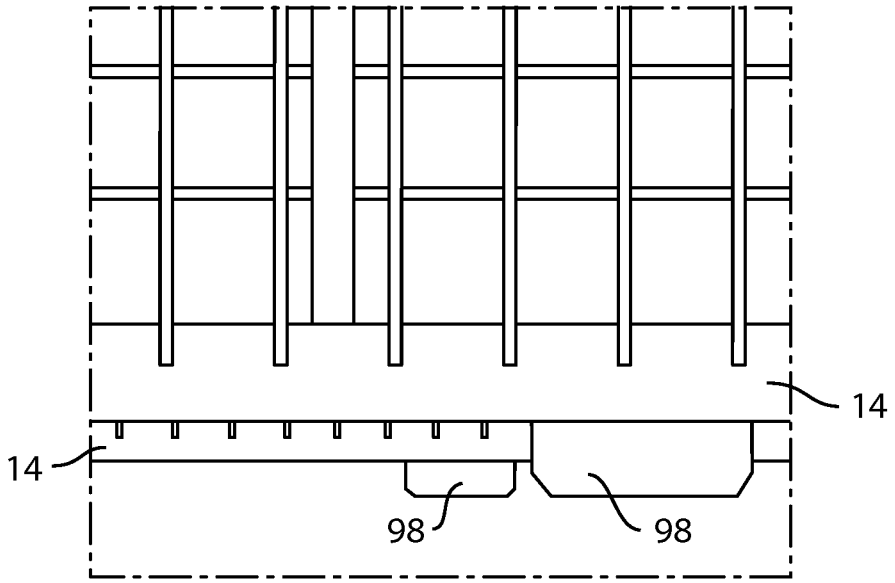
FIG. 16 shows a shelf with a shelf tab.
Figure 17:
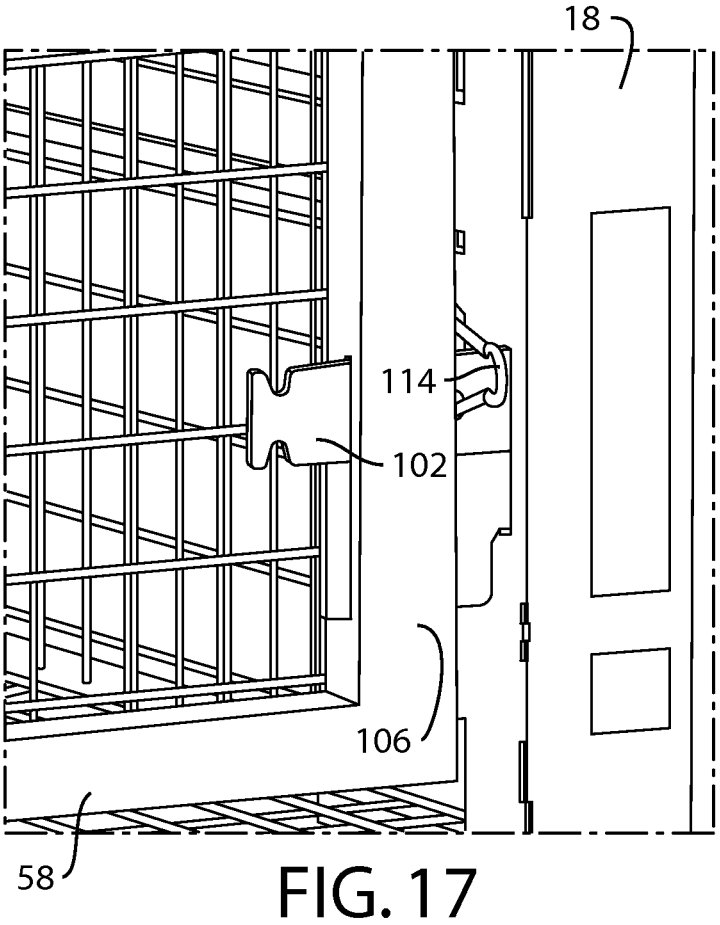
FIG. 17 shows a slideable member attached to a front panel and a post.

The shelves 14, front panel 58, and rear panel 62 may have security tabs and slide locks incorporated into them to prevent the removal of shelves and panels, thus securing the material being shipped. Shelf tabs prevent removing shelves while the front panels are in place making the item inaccessible. FIG. 16 shows a shelf 14 with a shelf tab 98 configured to slide into front panel 58 or rear panel 62. Slide locks are installed on the intermodal containers to lock the front panel 58, and rear panel 62 into the posts 18. FIG. 17 shows a front panel 58 adjacent to a post 18. A slideable member 102 can slide into a front panel support 106 and into post 18. A locking devices 114 can attach to a hole 110 in the slideable member that is located generally between the post 18 and the front panel support 106. When the pad lock 114 is attached and locked to the hole 110, the slideable member 102 cannot be removed from the post 18 and front panel support 106, and the front panel is locked in place, thereby preventing the removal of the material being transported. The locking device 114 may be a pad lock, or snap link may be used to simply hold the slideable member 102 in place (as shown).

Figure 18:
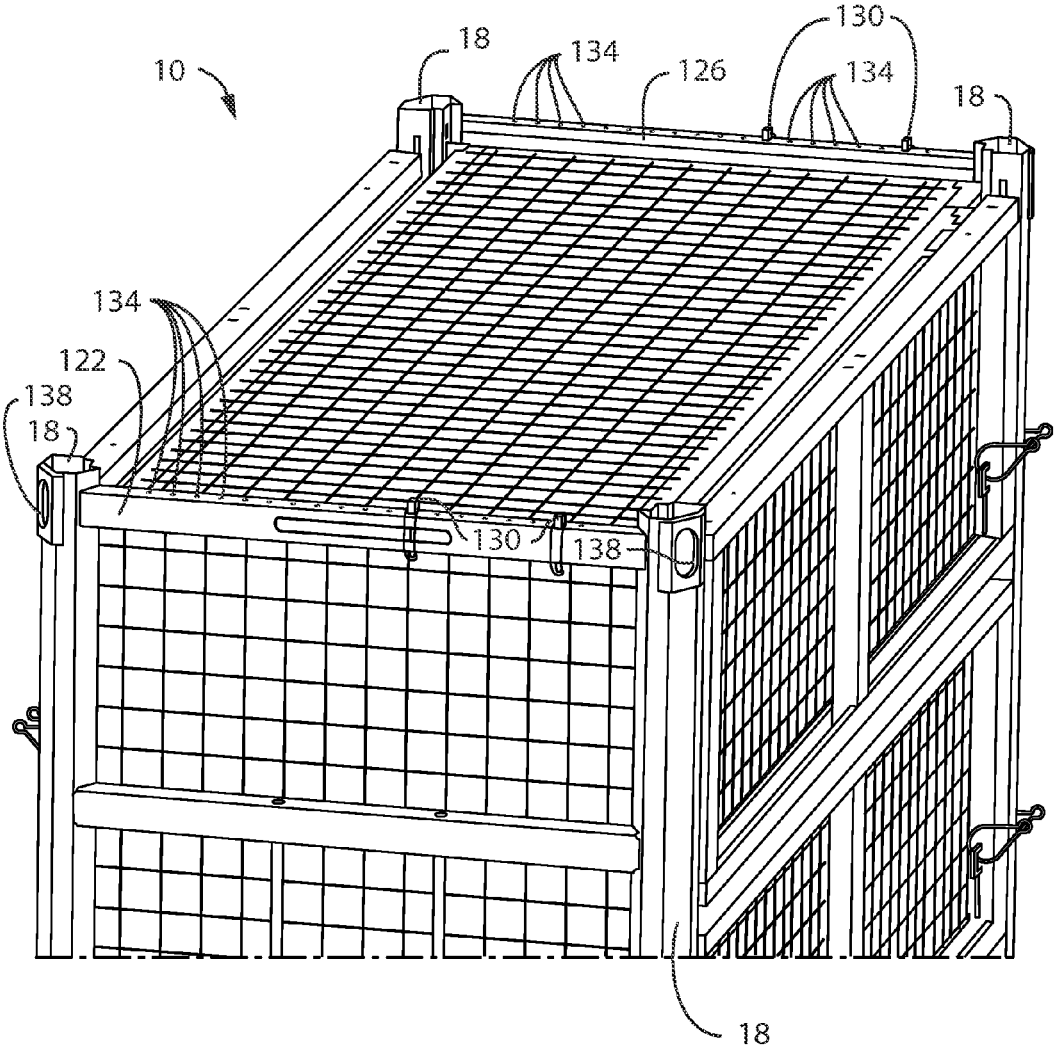
FIG. 18 shows a perspective view of the top of an intermodal container.

FIG. 18 shows a top perspective view of an intermodal container 10. A first cross-member 122 is located near the top and attached to two posts 18 on one side of the intermodal container 10. A second cross-member 126 is located near the top and attached to two posts 18 on the opposite side of the intermodal container 10. There are a plurality of holes 134 located through the top side and bottom side (bottom side not visible in this view) of cross-members 122, 126. Two locking pins 130 are stored in each cross-member 122, 126 via the holes 134. The cross-members 122, 126 each have an inner cross-member 194 (not visible in this view) that is slideable within the cross-member 122, 126. The inner cross-member 194 also has holes 134 located through the top side and bottom side of the inner cross-member. The inner cross-members 194 can slide out through the post holes 138 in the posts 18 (all four posts 18 have the holes 138). In FIG. 18, the inner cross-members 194 are stored generally completely inside the cross-members 122, 126. In one embodiment, only one of the two cross-members 122, 126 will have innermost cross-member 198 that slides within inner cross-member 194. The innermost cross-member 198 will also have holes 134 located through the top side and bottom side of the innermost cross-member 198. Innermost cross-member 198 is not visible in this view.

Figure 19:
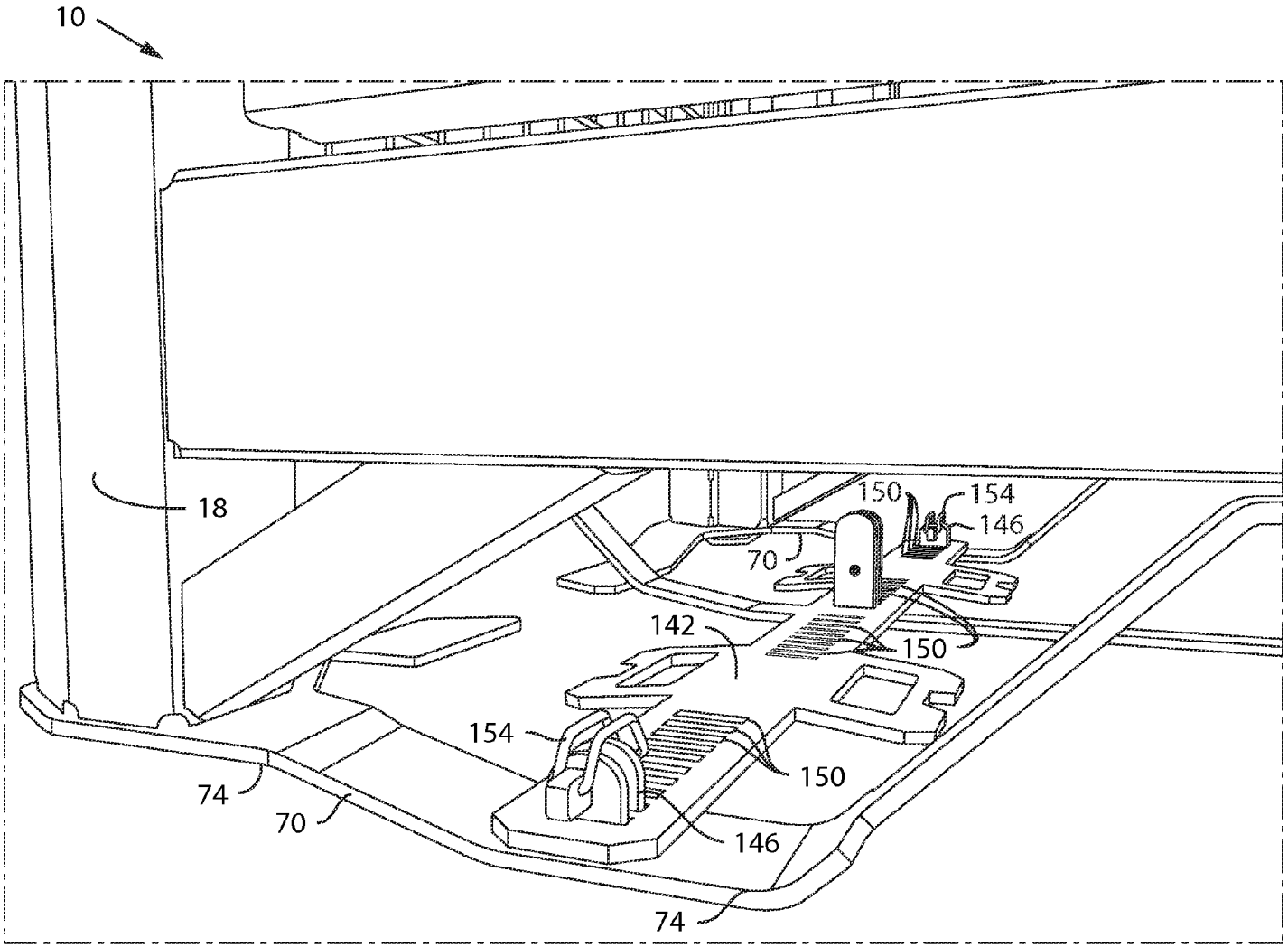
FIG. 19 shows a close-up view of a side support member and bracing member.

FIG. 19 shows a close up view of a side support member 70. A bottom bracing member 142 is removeably attached to the side support members 70 via at least two tabs 146 extending from the side support member 70 and going through at least one of a plurality of slots 150 located on the bottom bracing member 142. The tabs 146 have holes to go through them. A locking pin 154 goes through the holes to lock the bottom bracing member 142 to the side support members 70. When the locking pins 154 are removed, one can lift the bottom bracing member 142 from the tabs and move the bottom bracing member 142 so that the tabs 146 can go through another pair of slots 150, thereby extending the bottom bracing member 142 out from under the intermodal container 10. The bracing member 142 as shown in FIG. 19, is being stored under the intermodal container 10. There is a second bottom bracing member 158, slots 150, and tabs 146 and pins 154 attached to another side support member 70 not visible in this view.

Figure 20:
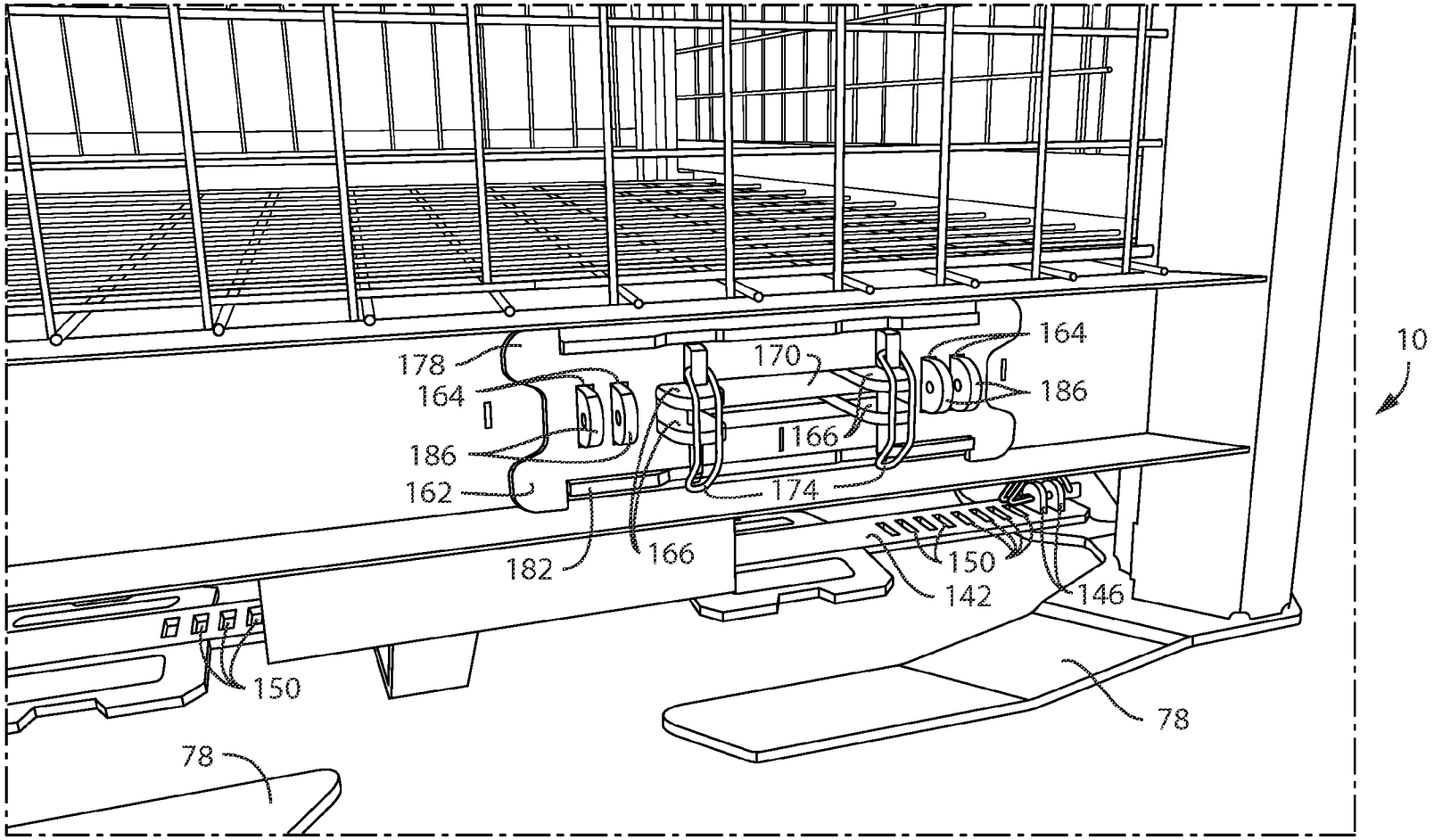
FIG. 20 shows a close-up view of a front support member and locking sleeve.

FIG. 20 shows one embodiment of how a locking sleeve 162 may be stored on the side of the intermodal container 10. Side tabs 166 are attached to a side of the intermodal container 10. The locking sleeve 162 has at least one slot 170 that allow the locking sleeve 162 to slide over the tabs 166. Locking pins 174 hold the locking sleeve 162 to the tabs 166. The locking sleeve 162 comprises an upper portion 178, and a lower portion 182. The lower portion has locking tabs 186. The locking sleeve 162 also has connector slots 164.

Figure 21:
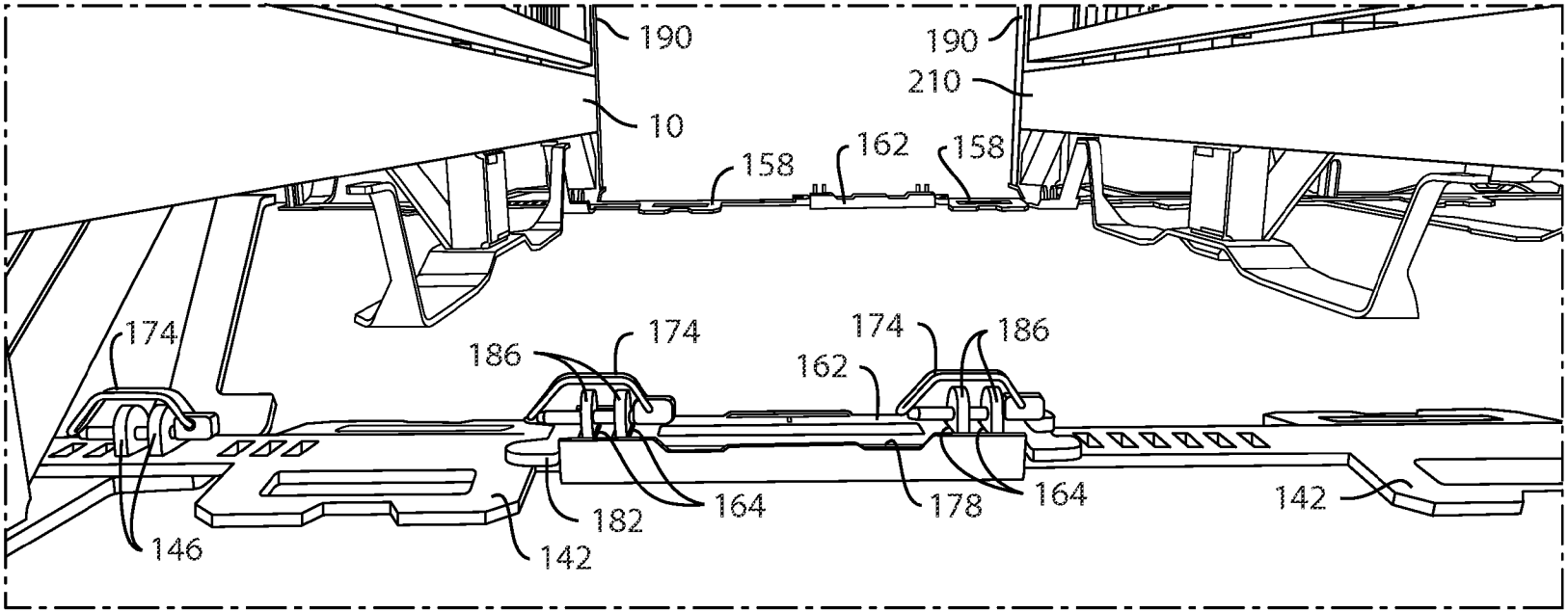
FIG. 21 shows a close-up view of a bottom bracing member.

FIG. 21 shows a view of the bottom of a first intermodal container 10 and a second intermodal container 210. A bottom bracing member 142 from the intermodal container 10 has been lifted up from the tabs 146, and moved from being completely under the intermodal container 10 and to the right, and is now attached to one set of tabs 146. The bottom bracing member 142 is also attached to the locking tabs 186 located on the lower portion 182 of the locking sleeve 162. Locking pins 174 hold the bottom bracing member 142 and upper portion 178 to the locking tabs 186. Similarly, a bottom bracing member 142 from the intermodal container 210 has been lifted up from the tabs 146, and moved from being completely under the intermodal container 10 and to the left, and is now attached to one set of tabs 146. The bottom bracing member 142 is also attached to the locking tabs 186 located on the lower portion 182 of the locking sleeve 162. Locking pins 174 hold the bottom bracing member 142 and upper portion 178 to the locking tabs 186. Similarly near the far end 190 of the intermodal container, the respect second bottom bracing members 158 are extended from under their respective intermodal containers 10, 210, and are connected to a locking sleeve 162.

Figure 22:
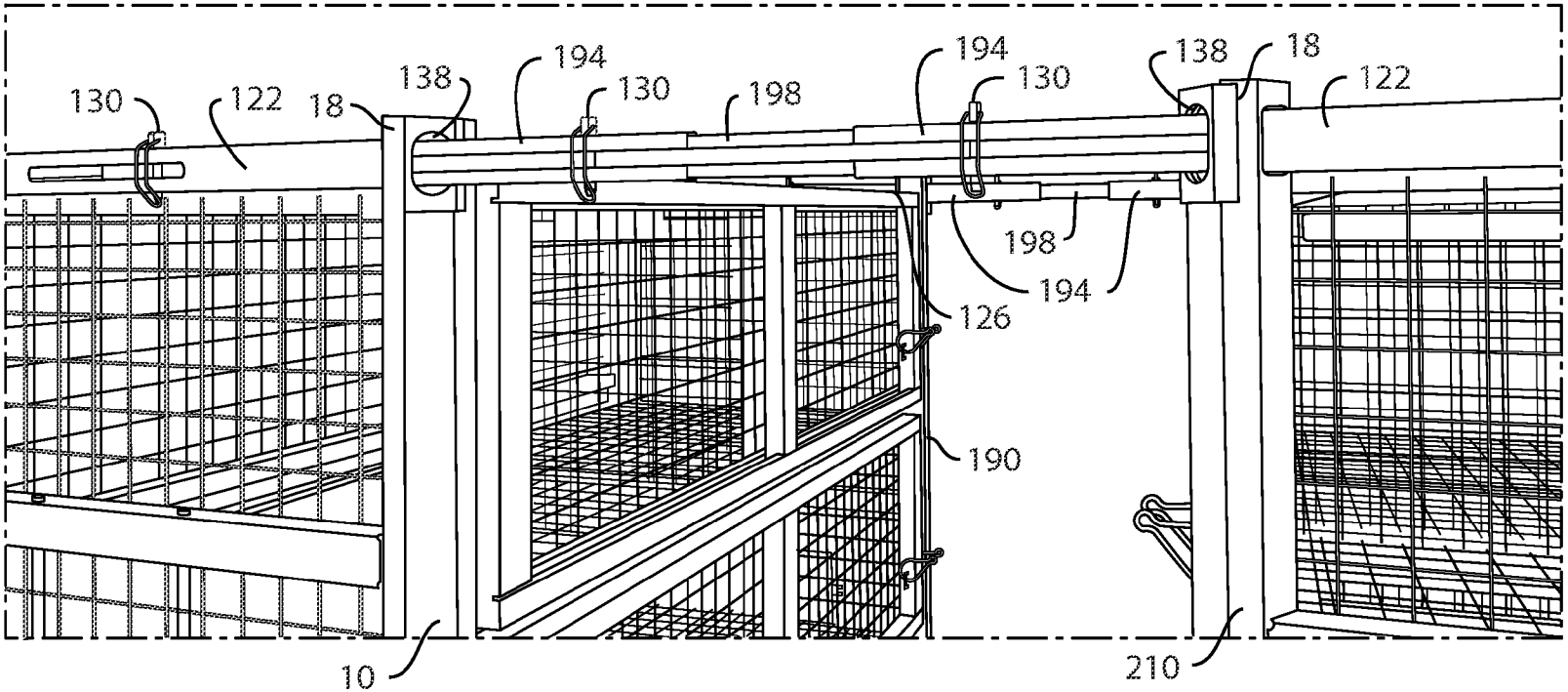
FIG. 22 shows a close-up view of the cross-members.

FIG. 22 shows a view of the top of a first intermodal container 10 and second intermodal container 210. Extending out and to the right from the cross-member 122 on the first intermodal container 10 is an inner cross-member 194. Extending from the inner cross-member 194 is an innermost cross-member 198. The innermost cross-member 198 is fixedly attached to the inner cross-member 194 via the locking pins 130 and the holes 134 in the cross-members 194, 198. Similarly, the inner cross-member 194 is fixedly attached to the cross-member 122 via the locking pins 130 and the holes 134 in the cross-members 194, 126. Extending out and to the left from the cross-member 122 of the second intermodal container 210 is an inner cross-member 194. The innermost cross-member 198 extends from the inner cross-member 194 of the first intermodal container 10 to the inner cross-member 194 of the second intermodal container 210. The innermost cross-member 198 is fixedly attached to the inner cross-member 194 (of the second intermodal container 210) via the locking pins 130 and the holes 134 in the cross-members 194, 198. Similarly, the inner cross-member 194 of the second intermodal container 210 is fixedly attached to the cross-member 122 of the second intermodal container 210 via the locking pins 130 and the holes 134 in the cross-members 194, 126 (not visible in this view). Similarly, near the far end 190 of the intermodal containers 10, 210, the cross-members 126 of both containers 10, 210, are telescoped and attached in generally the same way as the cross-members 122 described above.

Figure 23:
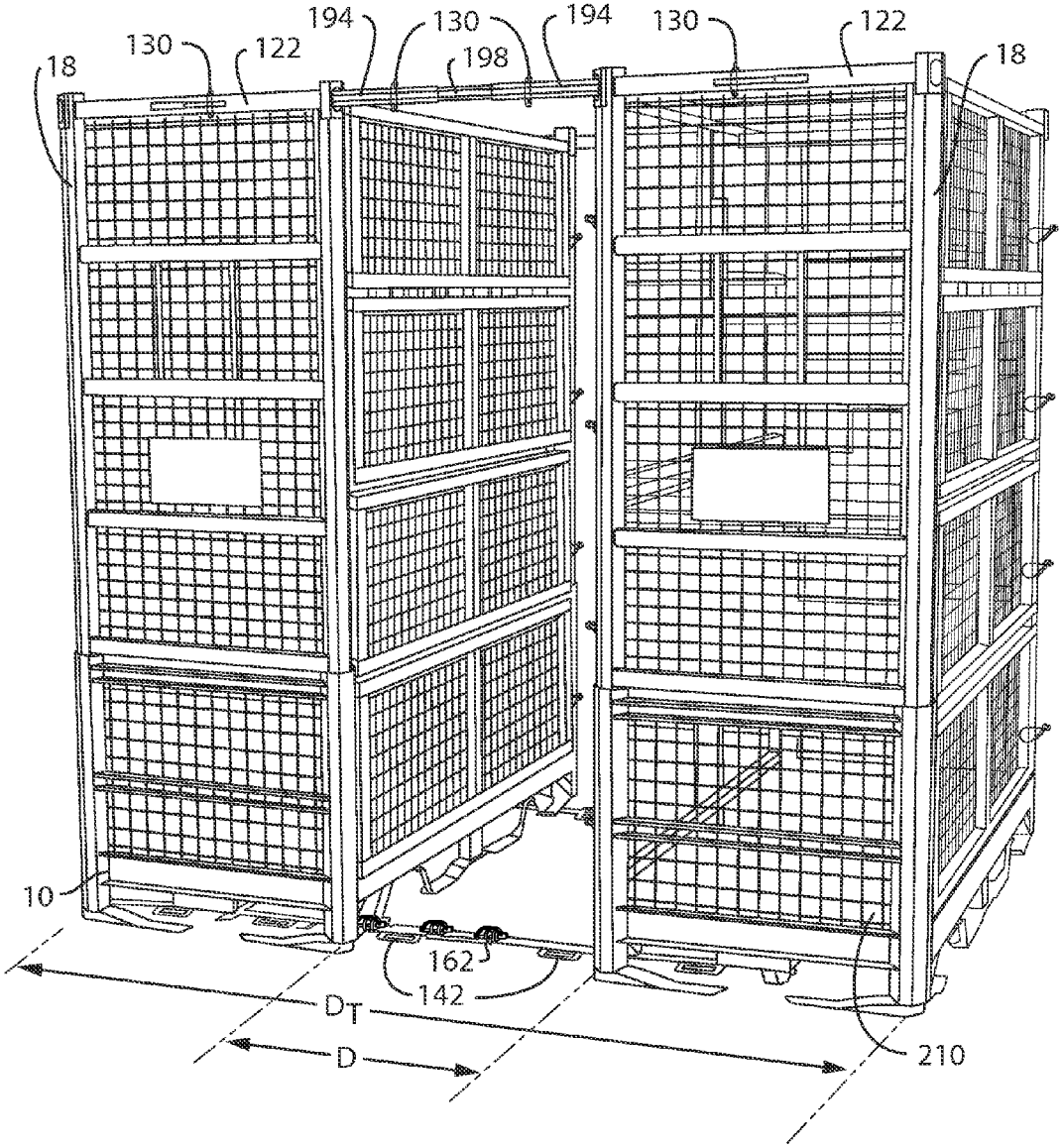
FIG. 23 shows a perspective view of two intermodal containers braced a certain distance apart.

FIG. 23 shows a view of the first and second intermodal containers 10, 210. In this view, one can see how the bracing members lock the two intermodal containers 10, 210 a certain distance D (variable by the user depending on which holes in the cross-members are pinned, and by which slots in the bottom bracing members are pinned). Thus, a user can use the bracing members to lock the two intermodal containers far enough apart so that they can be braced up against the interior of a shipping container. In other words, the distance $D_T$ may be generally the same, or just slightly smaller than the interior width or length of a shipping container. Hence, the intermodal containers 10, 210 and their contents will be secure and very unlikely to move or shift during transport. The bracing members are integral to the intermodal containers 10, 210, and thus, extra bracing material is not necessary.

Figure 24:
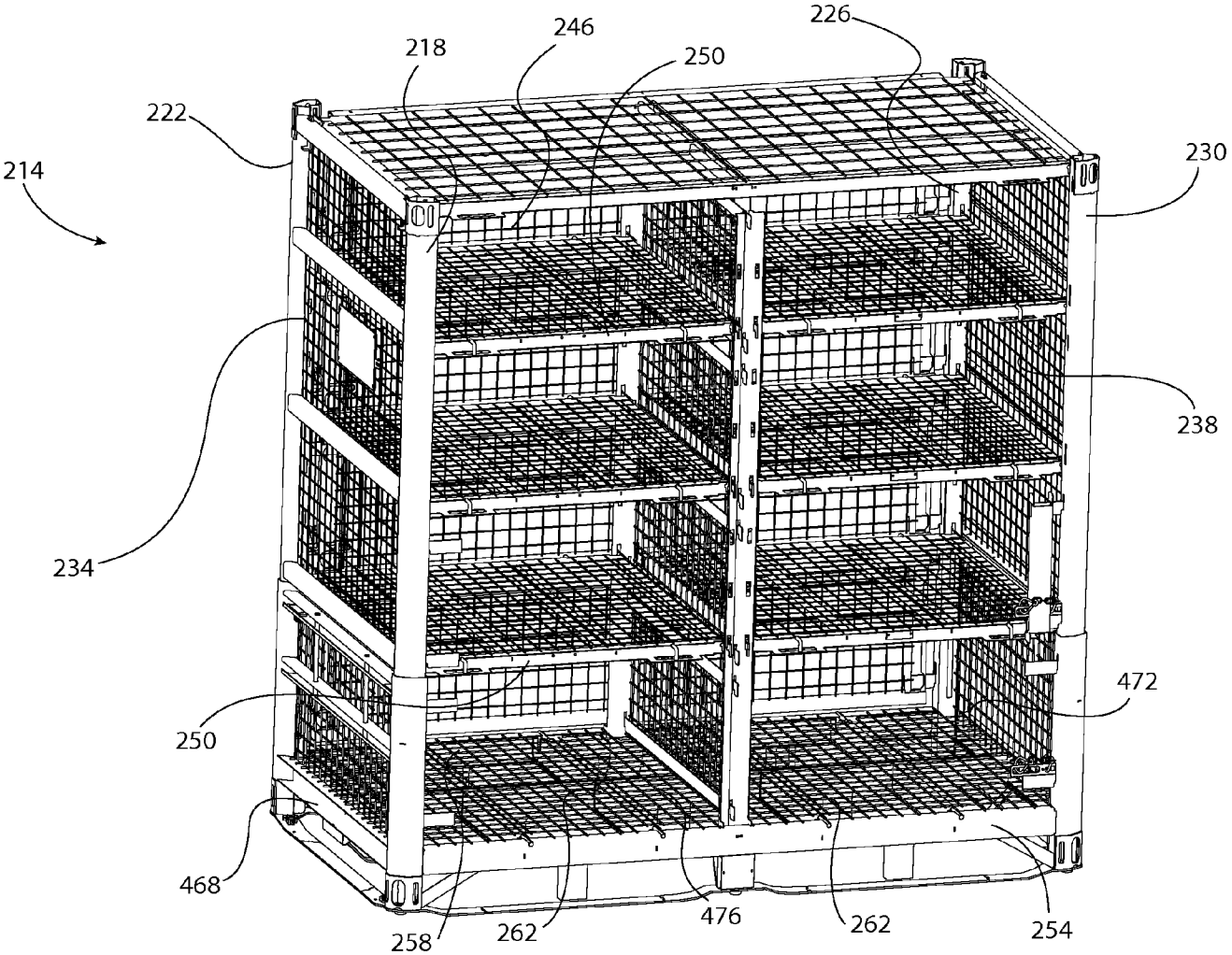
FIG. 24 is a perspective view of another embodiment of an intermodal container.

FIG. 24 shows another embodiment of the disclosed intermodal container 214. Shown are a first post 218, second post 222, third post 226, and fourth post 230. Between the first and second post is a first side panel 234. Between the third post 226 and fourth post 230 is a second side panel 238. Between the first post 218 and fourth post 230 is a front panel 242 (removed in this view for clarity), and between the second post 222 and third post 226 is a rear panel 246. There is also at least one shelf 250 attached to the posts 218, 222, 226, 230. A front floor beam 254 is attached to the first post 218 and fourth post 230. A rear floor beam 258 is attached to the second post 222 and the third post 226. The front and rear floor beams 254, 258 may be near the bottom of the intermodal container 214. There may be one or more cross beams 262 attached to the front and rear floor beams 254, 258 and located generally at the bottom of the intermodal container 214. There may also be a first side floor beam 468, second side floor beam 472, and one or more longitudinal cross beams 476 attached to the first side floor beam 468 and second side floor beam 472.

Figure 25:
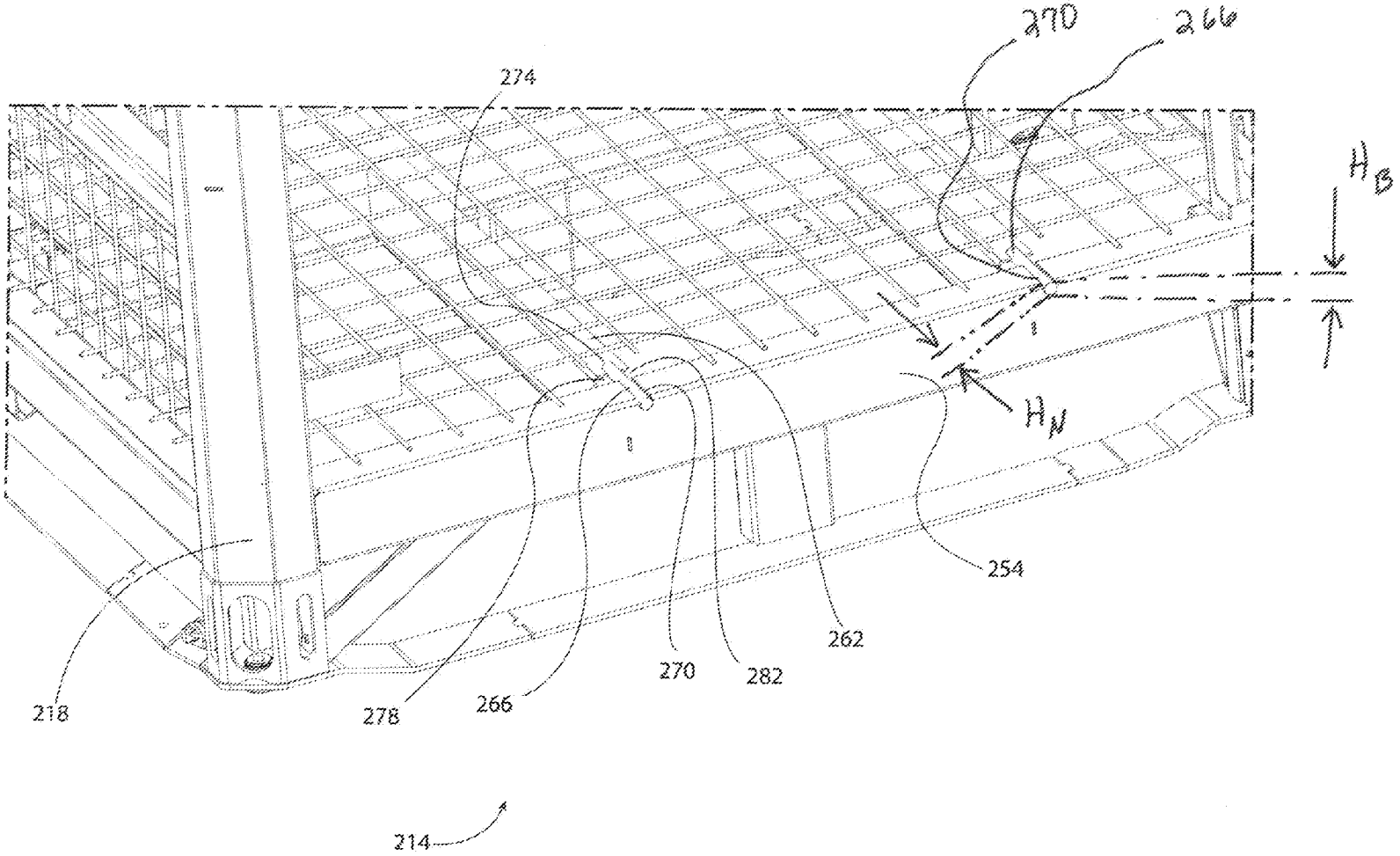
FIG. 25 shows a close up view of the front floor beam and a cross beam.

FIG. 25 shows a close up view of the front floor beam 254 and a cross beam 262. In this view a cylindrical shaped bar 266 is shown attached to the front floor beam 254 and cross beam 262. The bar 266 may sit in a first floor beam notch 270 cut into a horizontal surface of the front floor beam 254 that goes down the vertical surface of the front floor beam so that the bar 266 can securely sit in the notch 270. In one embodiment, the notch 270 is cut across the entire width of the horizontal front floor beam 254 surface, and may be cut down the vertical surface of the front floor beam 254 to a depth of about the diameter of the bar 266. The notch 270 may be generally wide enough to accept the height of the bar 266. The bar 266 also sits in a first cross beam notch 274. The first cross beam notch 274 may be located adjacent and abutting a cut-out 278 located in the cross beam 262. The notch 274 may be generally wide enough to accept the height of the bar 266. The cut-out forms a gap 282 between the front floor 254 beam and cross beam 262. In one embodiment, the bar 266 sits in the first floor beam notch 270 traverses across the gap 282 and sits in the first cross beam notch 274. The bar may be permanently attached to the cross beam 262 and front floor beam 254 via any suitable permanent attaching means, including but not limited to welding. The gap 282 is configured to be large enough to allow a strap to wrap around the bar 266 between the cross beam 262 and front floor beam 254, and/or to allow a hook to attach to the bar 266 between the cross beam 262 and front floor beam 254. Although notches and cut outs in beams, such as the cross beam 262 and front floor beam 254, may tend to weaken the beams, the fact that a bar, made out of a strong weldable material, is welded to the notches, will actually increase the strength of the beams. A similar configuration may be used with the rear floor beam, a rear floor beam notch, a cross beam, a cross beam notch and cut-out and a second bar. In addition, there may be a similar configuration with the first side floor beam, a first side floor beam notch, a longitudinal cross beam, a longitudinal cross beam notch and cut-out and a third bar, the second side floor beam, a second side floor beam notch, a longitudinal cross beam, a longitudinal cross beam notch and cut-out and a fourth bar. Other shapes for the bar 266 may be used, including rectangular, triangular, trapezoidal, etc. $H_B$ is the height of the bar 266. $H_N$ is the depth of the notch 270. In one embodiment, $H_N$ may be about ¾ of $H_B$.

Figure 26:
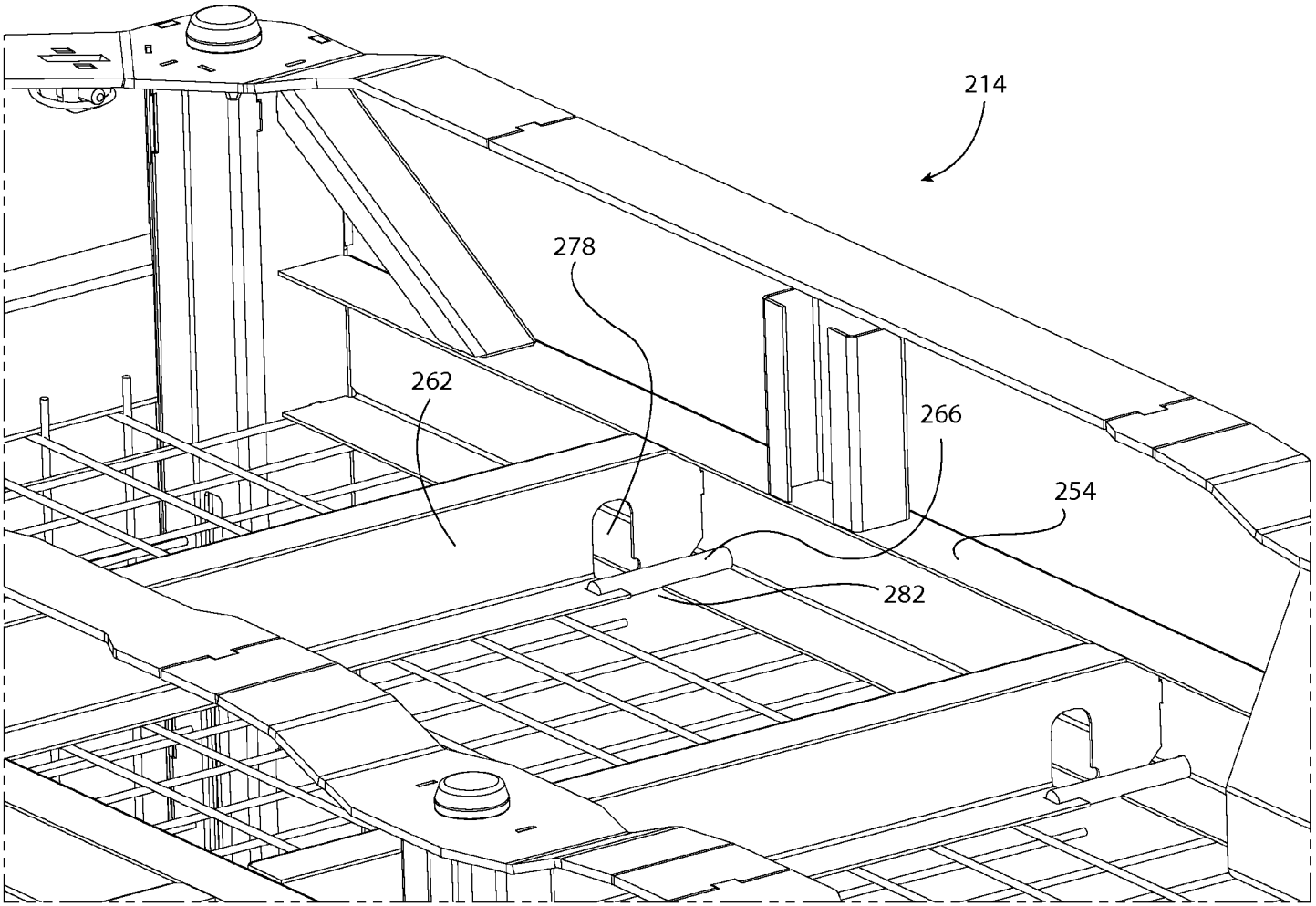
FIG. 26 shows an underside view of the cross beam and front floor beam.

FIG. 26 shows an underside view of the cross beam 262 and front floor beam 254. In this figure a clearer view of the cut-out 278 is shown, and shows how the cut-out 278 cuts a piece out of a horizontal surface of the cross beam 262 and piece is cut out of the vertical surface of the cross beam 262, but yet the cross beam is still attached to the front floor beam 254.

Figure 27:
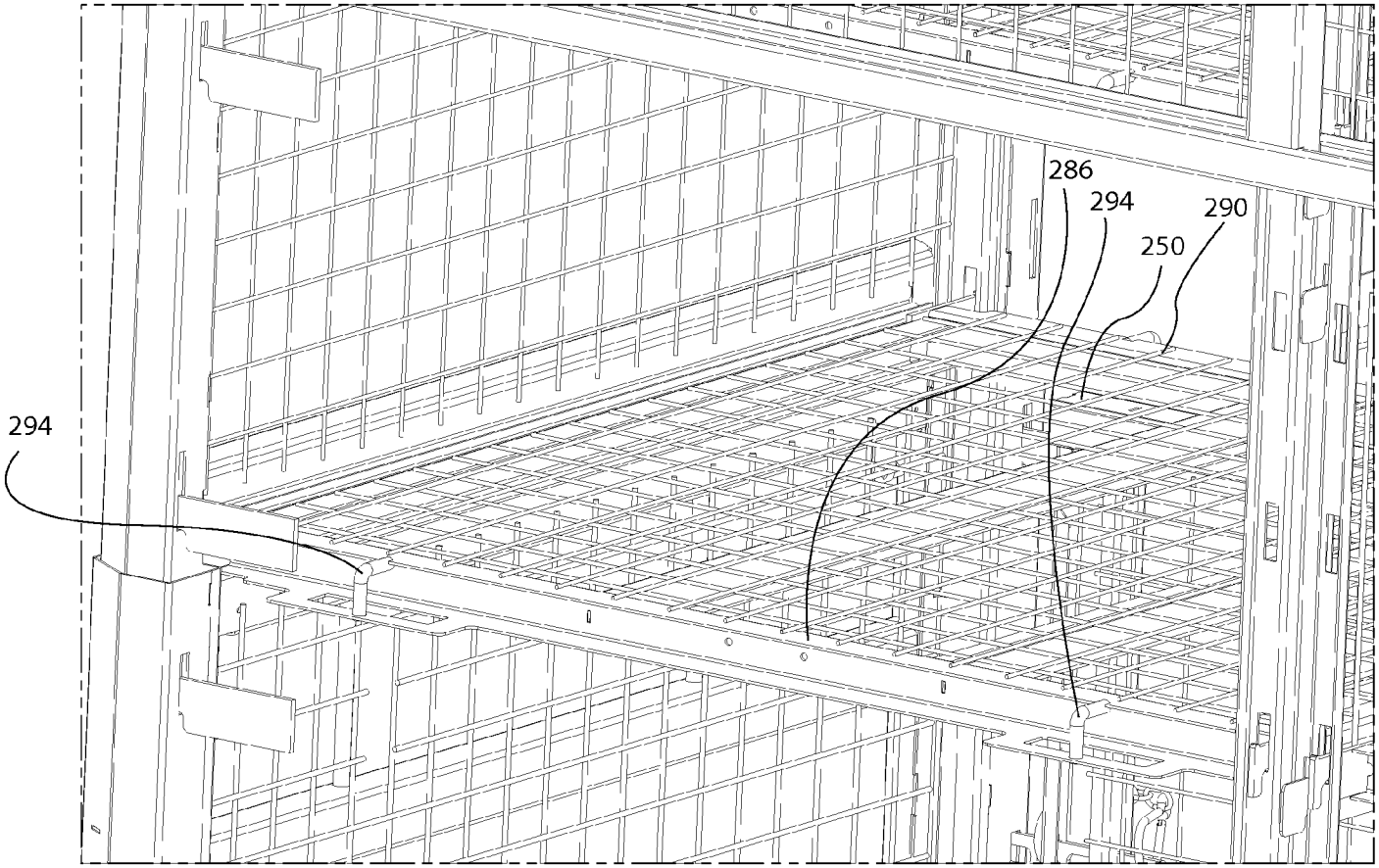
FIG. 27 shows a close up view of a shelf.
Figure 28:
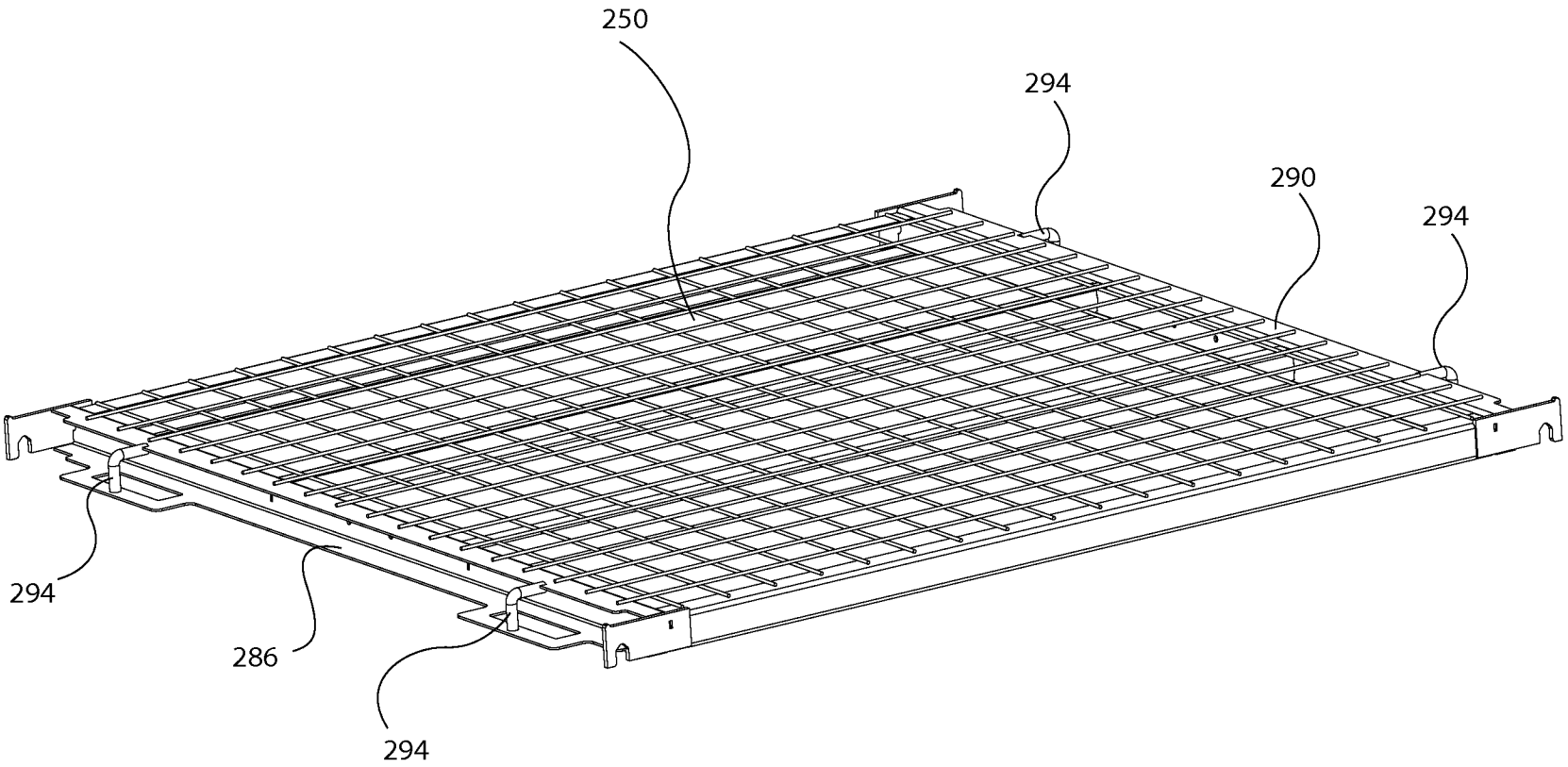
FIG. 28 is another view of the shelf from FIG. 27.

FIG. 27 shows a close up view of a shelf 250. The shelf, in this embodiment, comprises a front beam 286, and a rear beam 290. Extending from the front beam 286 are two strap bars 294. FIG. 28 shows a perspective view of a shelf 250 removed from the intermodal container 214. In this view two strap bars 294 extending from the front beams 286 are clearly visible, as well as two strap bars 294 extending from the rear beam 290. The strap bars 294 are configured to allow a strap to wrap around the strap bars 294 in order to secure objects on the shelf 250 or otherwise in the intermodal container 214, the strap bars also give users a handle to grab on to in order to easily pick up and move the shelves 214. The strap bars 294 also can help hold the shelf in place with respect to the front and rear panels. The strap bars prevent the shelf from moving in the XY plane, i.e. the plane that is generally parallel to the shelf. When the intermodal container is bouncing up and down and the shelf has bounced up, it can move in the XY plane unless the gap between the strapbar and the front panel is small. Then it can only move as much as this gap. Without the strapbars it is possible that the shelf could move enough during bouncing of the intermodal container, that the shelf could come loose from the corner posts. However, the strap bars will generally prevent the shelf from moving more than about 0.3 and generally about 0.5 inches of movement is necessary for the shelf to come loose from the corner posts.

Figure 29:
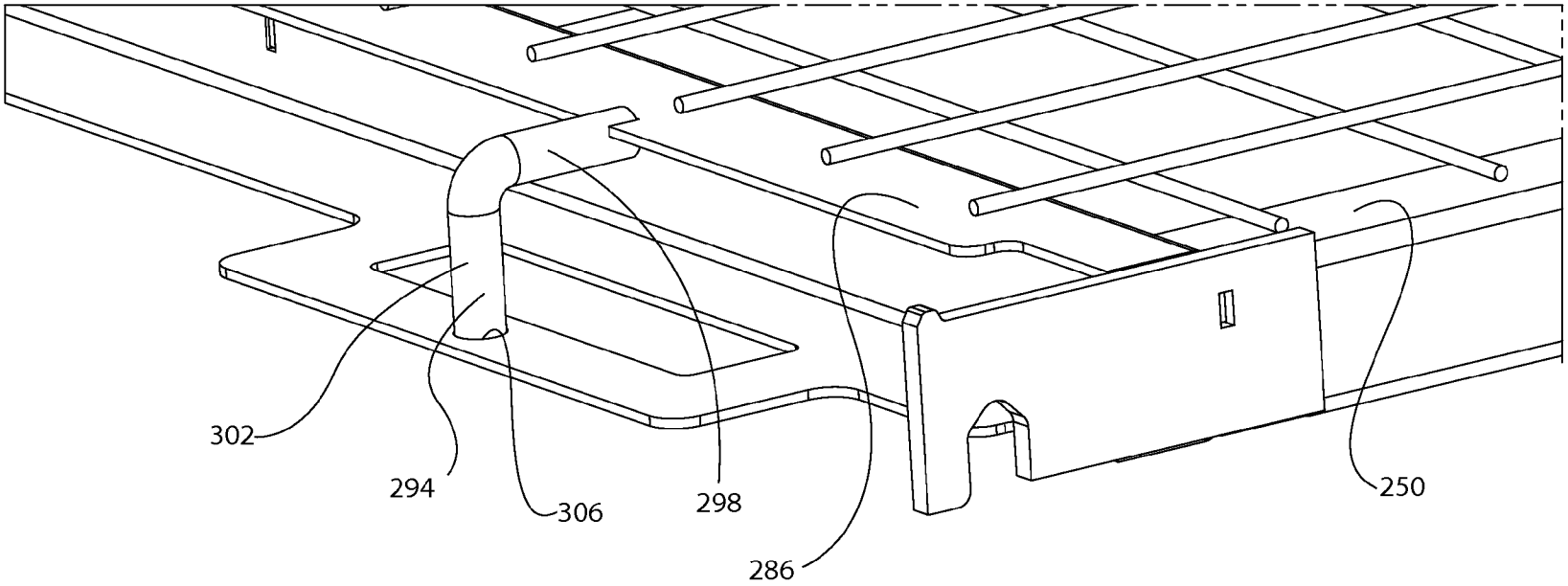
FIG. 29 shows a close up view of the front beam and one strap bar.

FIG. 29 shows a close up view of the front beam 286 and one strap bar 294. In one embodiment the strap bar 294 may comprise a horizontal member 298 that extends generally from the front beam away from the shelf 250, and a vertical member 302, where the far end or distil end 306 is attached to the front beam 286. In one embodiment, the cross-sectional shape of the strap bar 294 may be generally circular.

Figure 30:
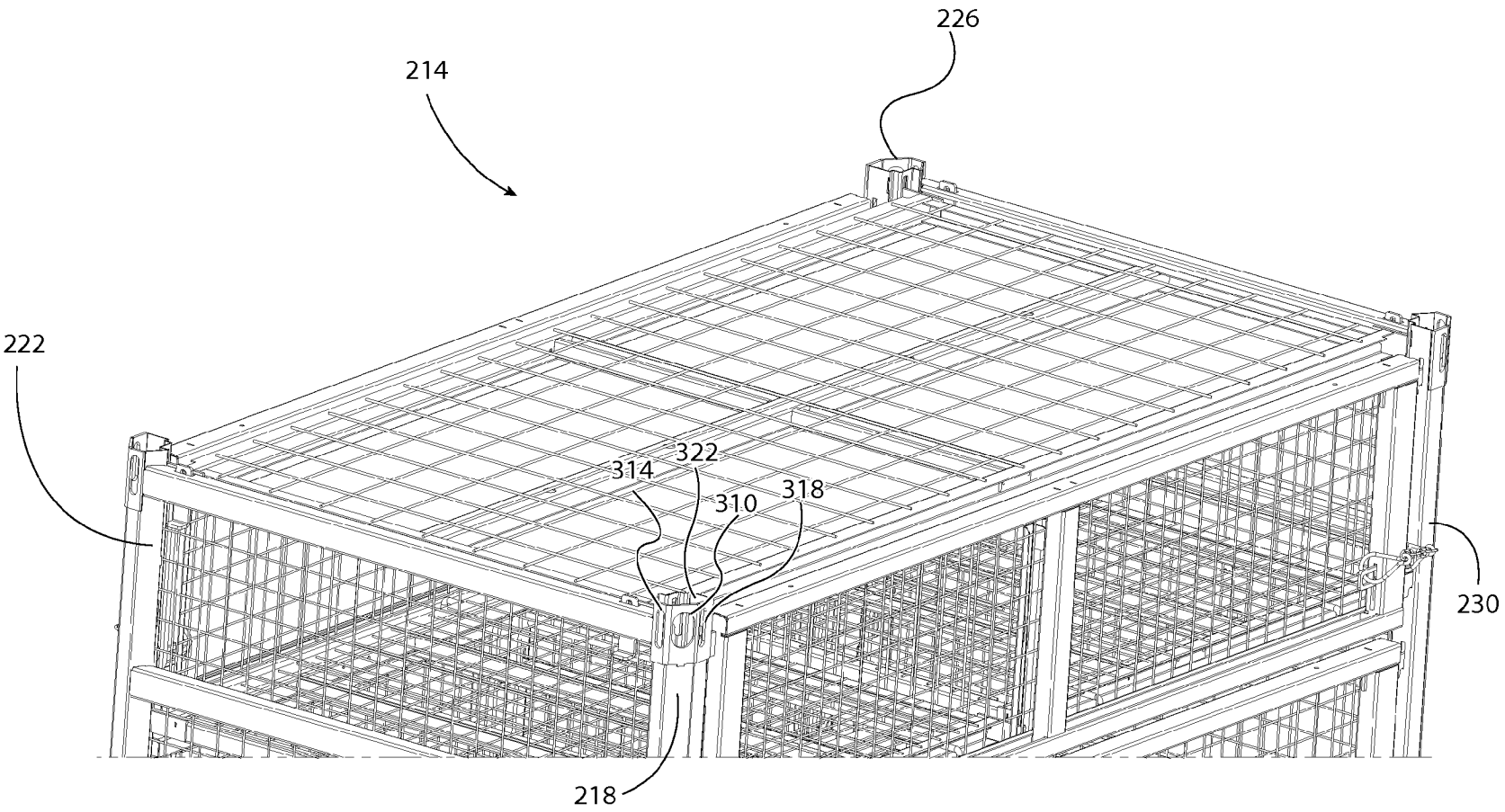
FIG. 30 shows a close up view of the first post and second post of the intermodal container.

FIG. 30 shows a close up view of the first post 218 and second post 222 of the intermodal container 214. In this view you can see that each of the top of the posts has four openings. Referring to the first post 218, one can see a first post top center hole 310, a first post top front hole 314, and a first post top side hole 318. In one embodiment, there may be a first post top opening 322. The fourth post 230 have similarly arranged post top holes and top opening. The center hole 310 and top opening 322 are configured to be large enough to accept a cargo strap to allow the strapping down of items being carried in the intermodal container. The top side hole 318 and top front hole 314 also may be configured to be large enough to accept a cargo strap to allow the strapping down of items being carried in the intermodal container. In another embodiment, the top side hole 318 and top front hole 314 may be configured to be large enough for a locking mechanism to fit into the holes 314, 318 in order to lock two adjacent intermodal containers together.

Figure 31:
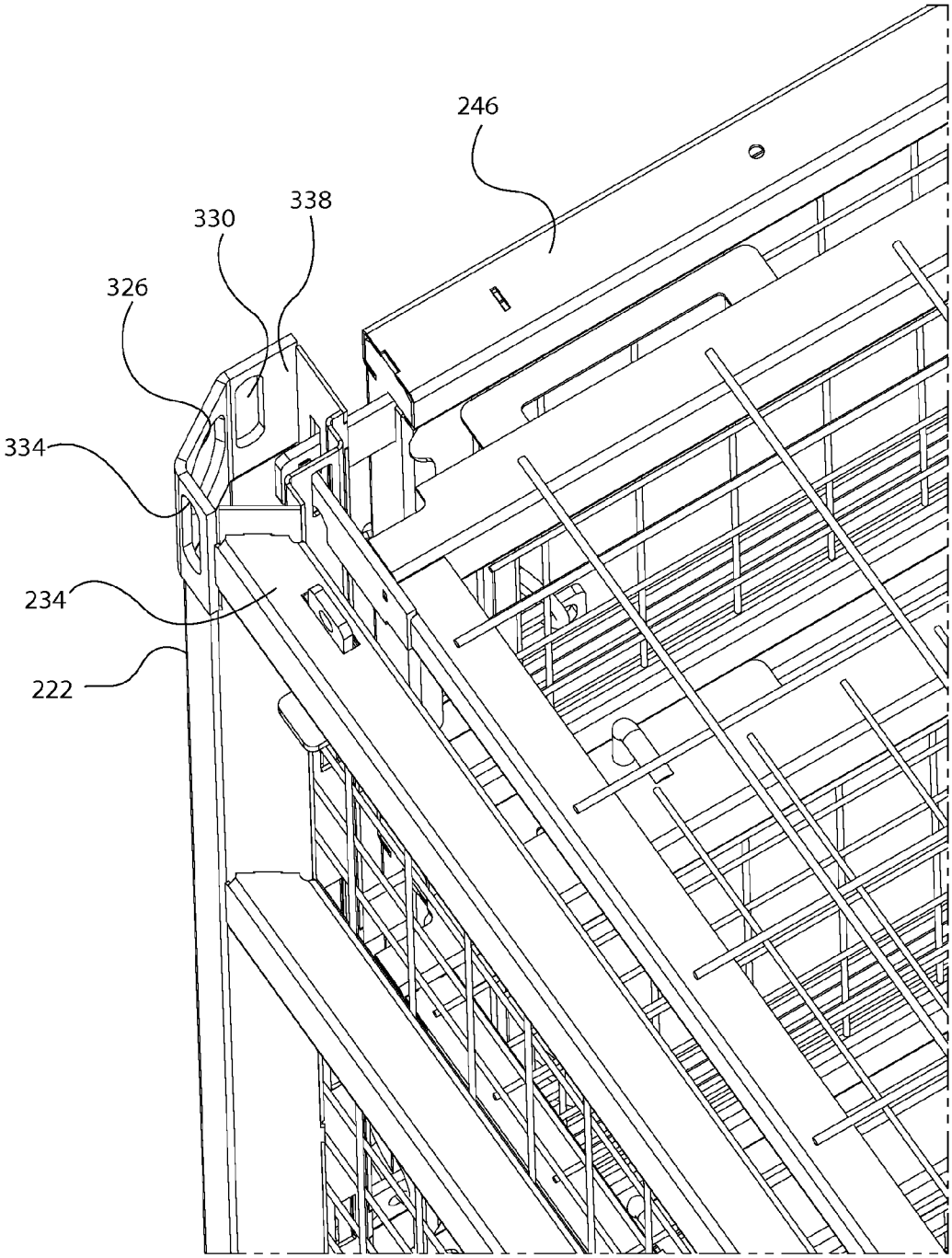
FIG. 31 is a close up view of the top of the second post.

FIG. 31 is a close up view of the top of the second post 222. The second post 222 has a second post top center hole 326, a second post top rear hole 330, and a second post top side hole 334, and a second post top opening 338. The second and third posts, because they are on either side of a rear panel, will have a top center hole, a top rear hole, and a top side hole. The first and fourth posts, because they are on either side of a front panel, will have a top center hole, top front hole, and top side hole.

Figure 32:
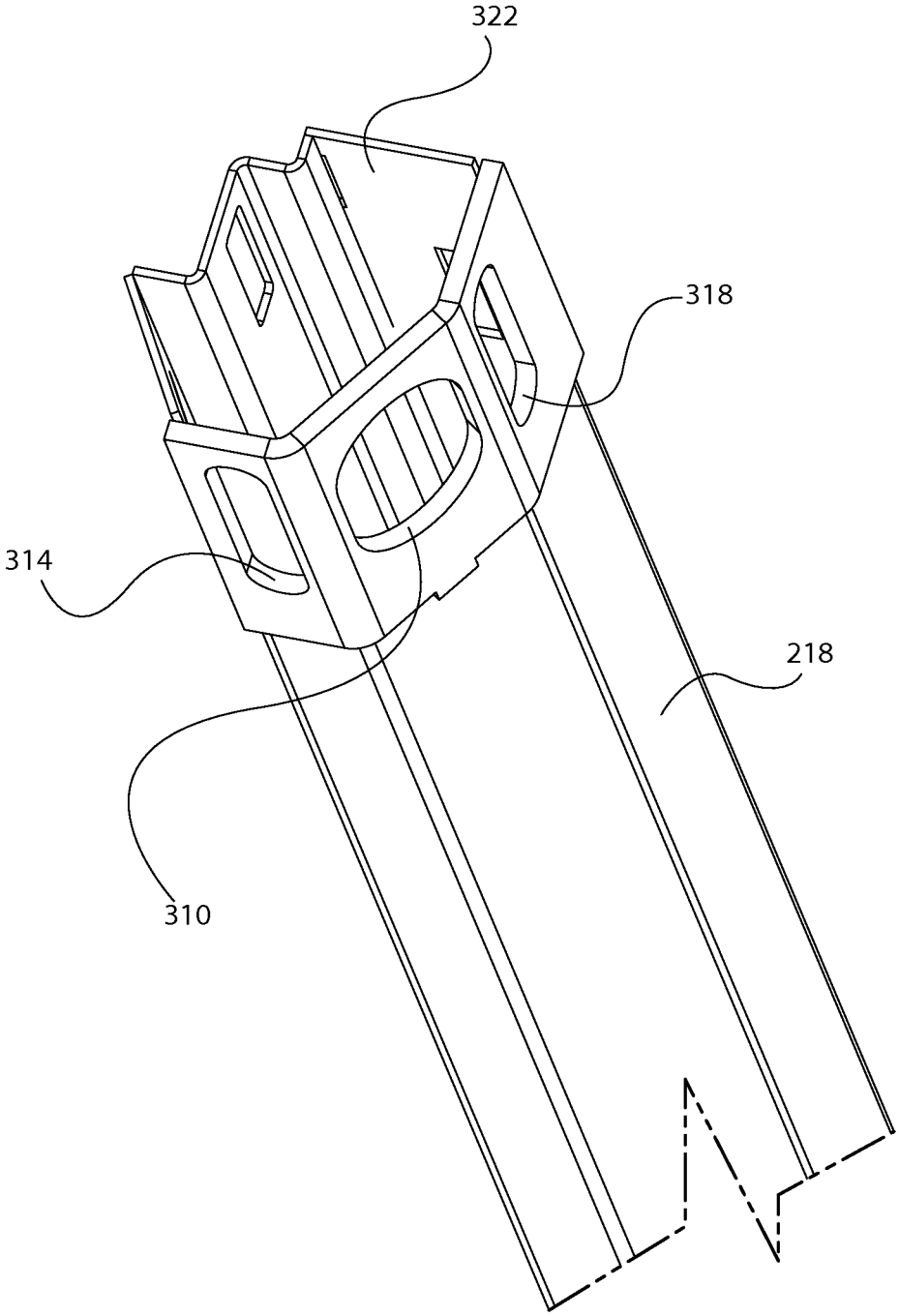
FIG. 32 shows a close up view of the top of the first post.

FIG. 32 shows a close up view of the top of the first post 218.

Figure 33:
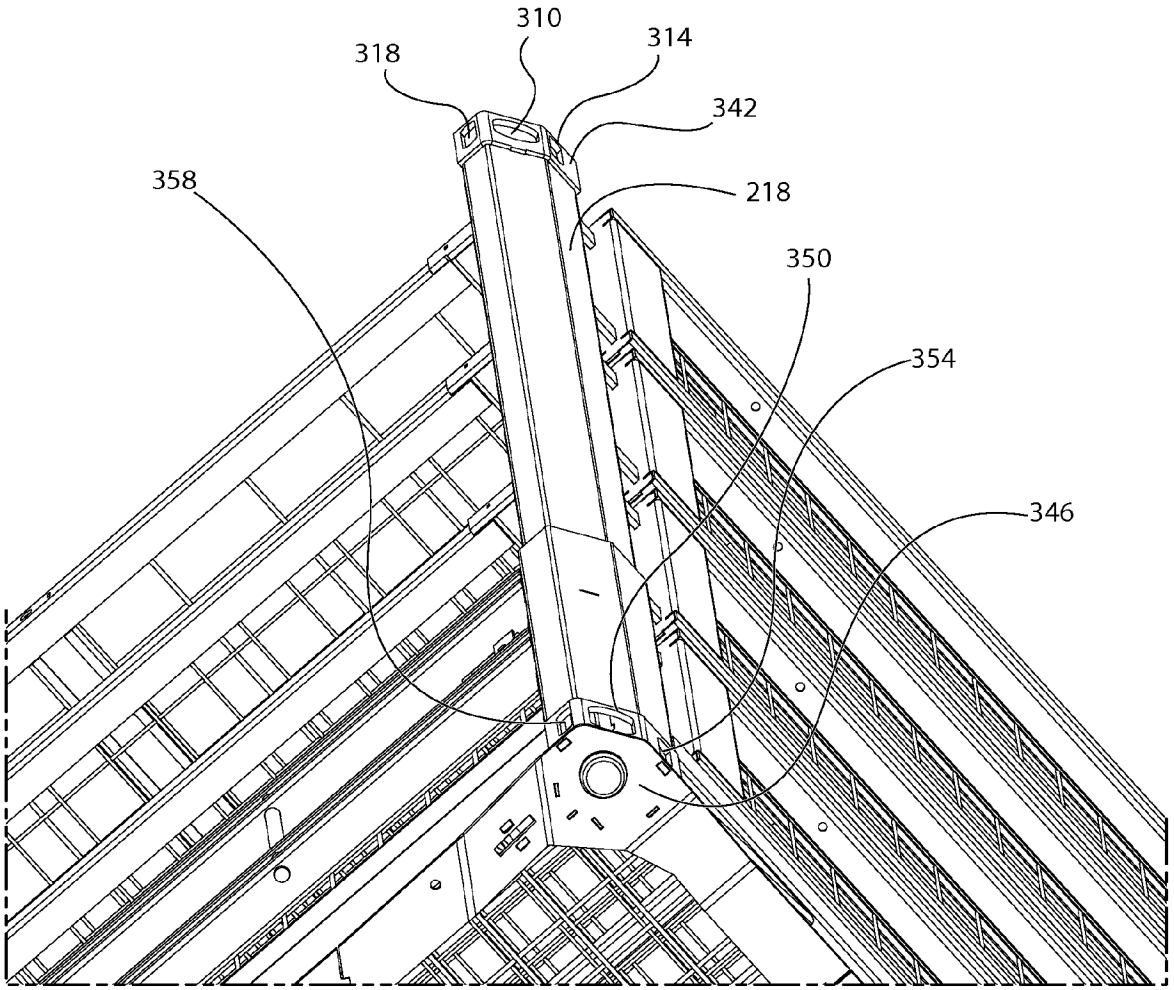
FIG. 33 shows a bottom perspective view of the first post.
Figure 42:
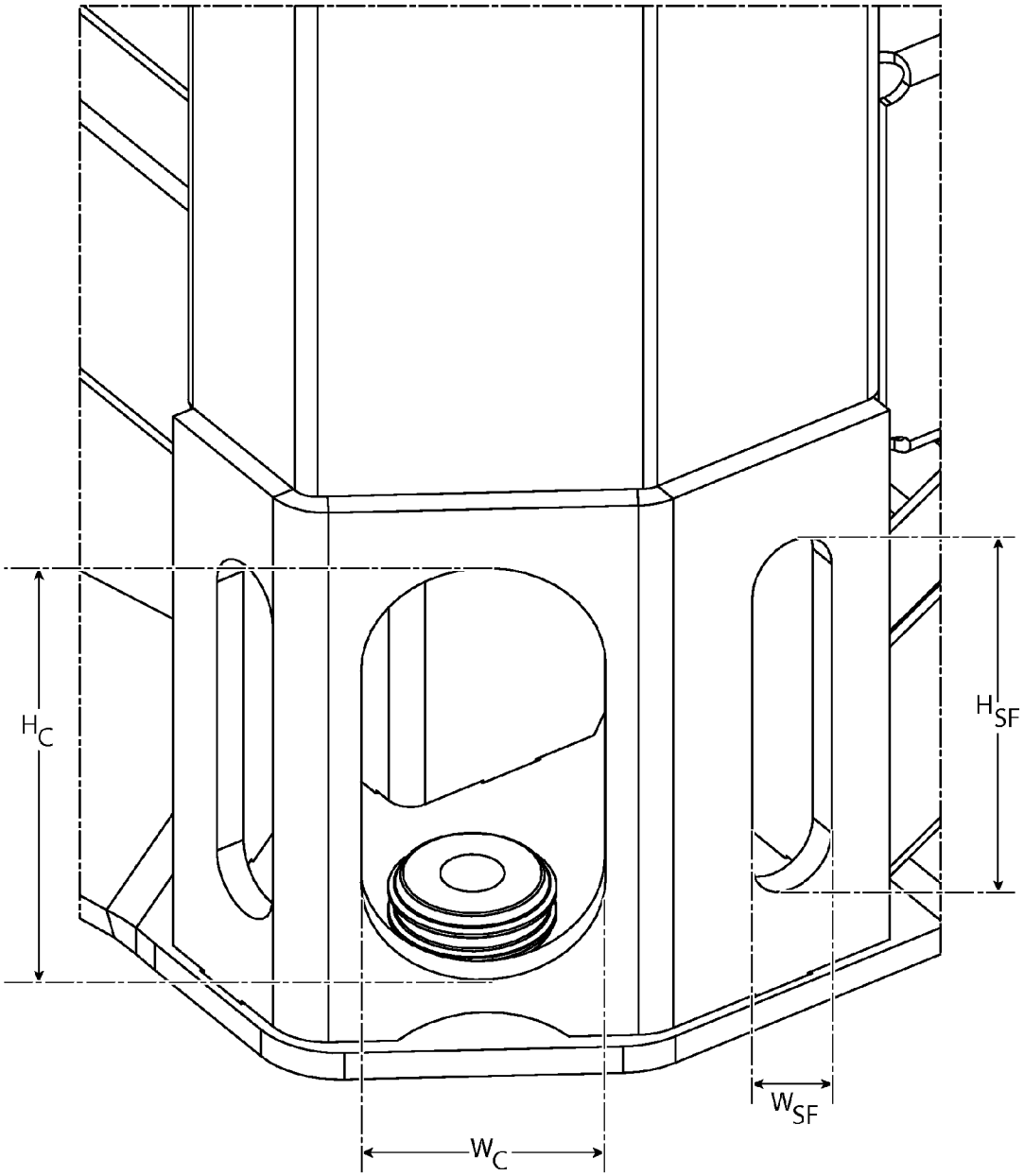
FIG. 42 is a perspective view of the center hole, side hole, and front hole.

FIG. 33 shows a bottom perspective view of the first post 218. The top 342 of the first post 218 is shown as well as the bottom 346 of the first post 218. In this view, one can see that the bottom of the first post has three openings. One can see a first post bottom center hole 350, a first post bottom front hole 354, and a first post bottom side hole 358. In the shown embodiment, there is not an opening at the very bottom of the first post (compared to opening 322 at the top of the first post 218). The fourth post 230 may have similarly arranged post bottom holes. The center hole 350 may be configured to be large enough to accept a cargo strap to allow the strapping down of items being carried in the intermodal container. The bottom side hole 358 and bottom front hole 354 also may be configured to be large enough to accept a cargo strap to allow the strapping down of items being carried in the intermodal container. In another embodiment, the bottom side hole 358 and bottom front hole 354 may be configured to be large enough for a locking mechanism to fit into the holes 354, 358 in order to lock two adjacent intermodal containers together. The second post 222 and third post 226 may also have similarly placed holes at the bottom of those posts. The second and third posts, because they are on either side of a rear panel, will have a bottom center hole, a bottom rear hole, and a bottom side hole. In one embodiment, the center holes may be generally located in a plane that is generally at an angle of about 45° to the to the side panel, front panel, and rear panel, and generally face outward from the intermodal container, when the intermodal container is fully assembled (not broken down for storage), the front holes may be generally located in a plane parallel to the front panel and generally face outward from the intermodal container when assembled; and the rear holes may be generally located in a plane parallel to the rear panel and generally face outward from the intermodal container when assembled. FIG. 42 shows that the front holes and side holes have a height $H_{SF}$ and a width $W_{SF}$. The center hole has a height $H_C$ and a width $W_C$. In one embodiment, $H_{SF}$ may range from about 1 inch to about 6 inches, $W_{SF}$ may range from about ¼ inch to about 2 inches, $H_C$ may range from about 1.5 inches to about 8 inches, and $W_C$ may range from about 0.5 inches to about 4 inches. In another embodiment, $H_{SF}$ may be about 2.6 inches, $W_{SF}$ may be about 0.6 inches, $H_C$ may be about 3.1 inches, and $W_C$ may be about 1.5 inches.

Figure 34:
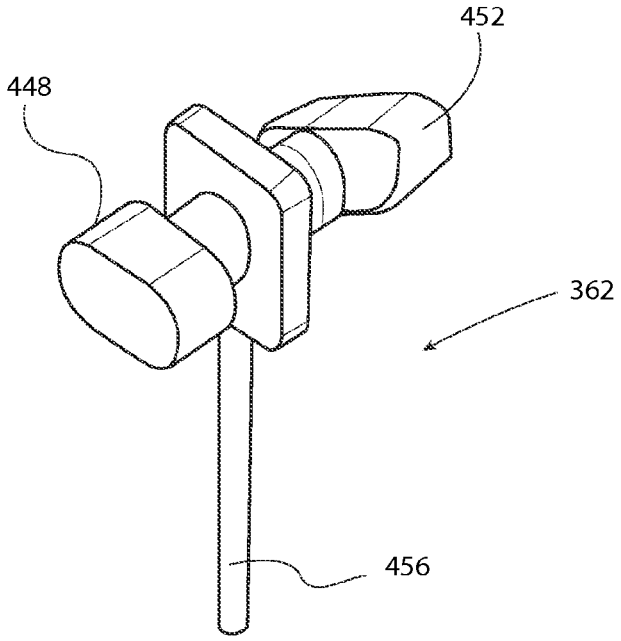
FIG. 34 is one embodiment of a locking mechanism.

FIG. 34 is one embodiment of a locking mechanism 362 to be used with the side, front, and rear holes discussed above, in order to lock two adjacent intermodal containers 214 together. Locking mechanism 362 comprises a first oblong member 448, and a second oblong member 452. The locking mechanism 362 also has a handle member 456. In one embodiment, the first and second oblong members 448, 452 are at about a 45° angle with respect to one another. The mechanism 362 can lock two intermodal containers 214 together by placing a first oblong member 448 inside a side hole 314, 318 of a first intermodal container, and then the second oblong member 452 can be placed inside the side hole 314, 318 of a second intermodal container 214. Of course, since the oblong members 448, 452 are staggered by 45°, one can use the handle to rotate the mechanism so that the second oblong member 452 can slide into the side hole 314, 318, while keeping the first oblong member 448 secured in the side hole 314, 318 of the first intermodal container. In another embodiment, hooks, straps, straps with ratcheting mechanisms may also be used with the side, front, and rear holes to lock two intermodal containers 214 together.

Figure 35:
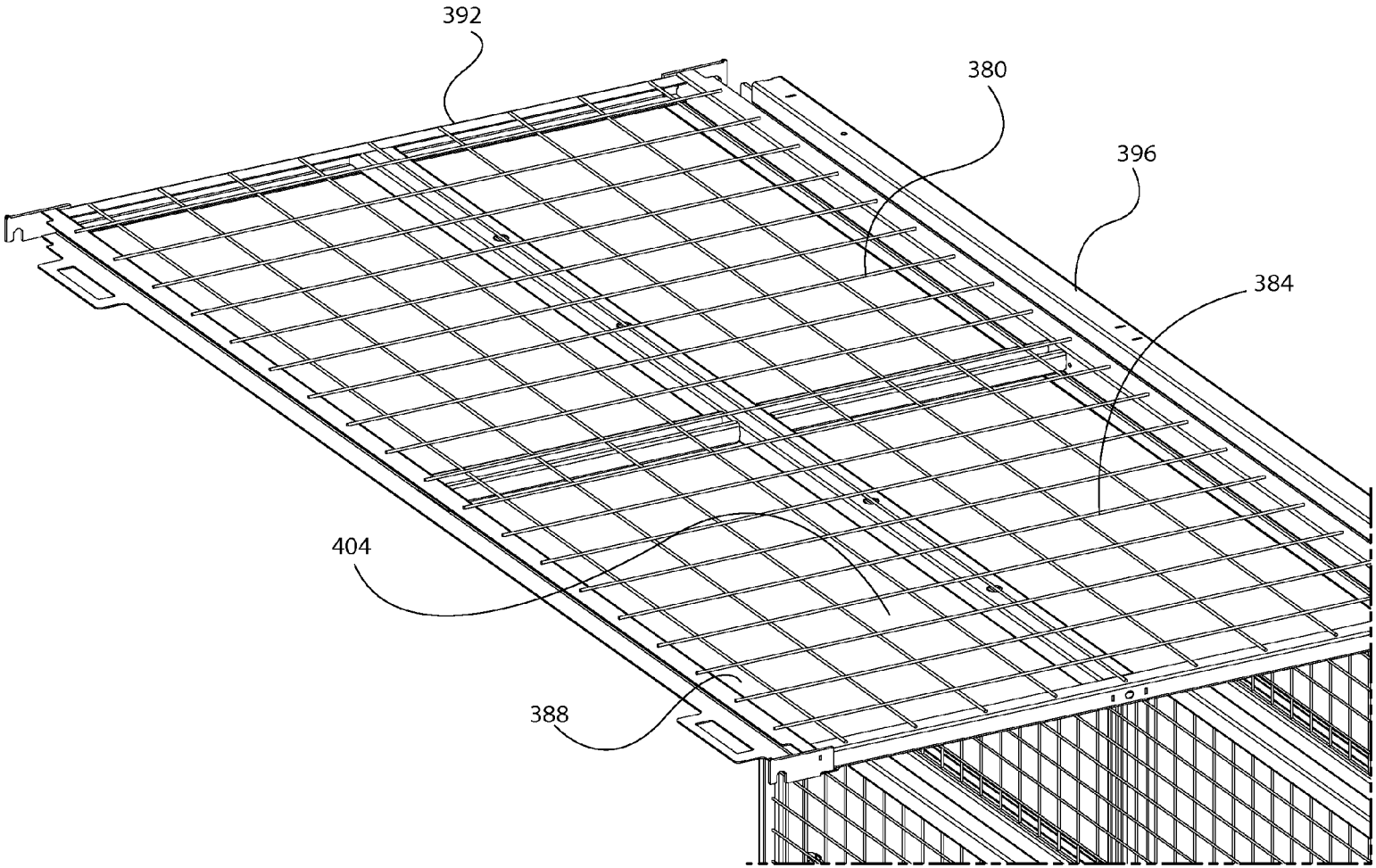
FIG. 35 shows a liquid barrier shelf.

FIG. 35 shows a liquid barrier shelf 380 that may be used with the intermodal container 214. The liquid barrier shelf 380 is attached to the first, second, third, and fourth posts. In one embodiment, the liquid barrier shelf 380 may only be attached to the top of the intermodal container. In other embodiments, the liquid barrier shelf may be attachable to the posts at a plurality of heights along the posts. The liquid barrier shelf 380 has a grid 384, a front beam 388 attached to the underside of the grid 384; a first side beam 392 attached to the underside of the grid and to the front beam 388 at generally a right angle to the front beam 388; a second side beam 400 attached to the underside of the grid 384 and to the front beam 388 at generally a right angle to the front beam 388; and a rear beam 396 attached to the underside to the grid 384 and to the first and second side beams 392, 400 at generally right angles to the first and second side beams 392, 400. There is also a liquid barrier plate 404 attached to the front beam 388, first side beam 392, second side beam 400 and rear beam 396, and located generally under the grid 384. The liquid barrier plate 404 generally will keep liquid from coming into contact with materials stored in the intermodal container underneath the liquid barrier shelf 380. Table 4 below shows some of the advantages of using a grid with a barrier plate. One can see that using both the plate and grid weighs about the same as using only the grid (only about a 5 pound difference in the shelf weight), but provides protection from sun, rain, dust, and increases the stiffness of the shelf. Also, the grid allows a user to have easy handholds when moving the shelf, as opposed to a large metal plate which is hard to carry and cumbersome. The plate plus grid weighs about 30 pounds less than just using a plate for a shelf. This is because when the grid and plate are welded or otherwise attached to each other to form the shelf, the grid and plate combination provides greater stiffness and strength at lower weight than a solid metal plate designed to hold 500 lbs.

TABLE 4

| | Description | Weight | Strength | Advantages | Disadvantages |
|---|---|---|---|---|---|
| Only grid | 4 mm grid with 1 inch spacing | 55 lbs | 500 lbs load | Low weight | Rain, dust and sun damages goods |
| Only plate | 1.5 mm thick plate, no grid | 90 lbs | 500 lbs load | Sun, rain and dust protection | Difficult to maneuver by one person because of lack of grid to use as handles, Very heavy |
| Plate + grid | 0.5 mm steel plate or 2 mm plastic plate + 4 mm grid with 2 inch spacing | 60 lbs for steel and 52 for plastic plate | 500 lbs load | Sun, rain and dust protection. Increased stiffness. Simplified handling. | |

Figure 36:
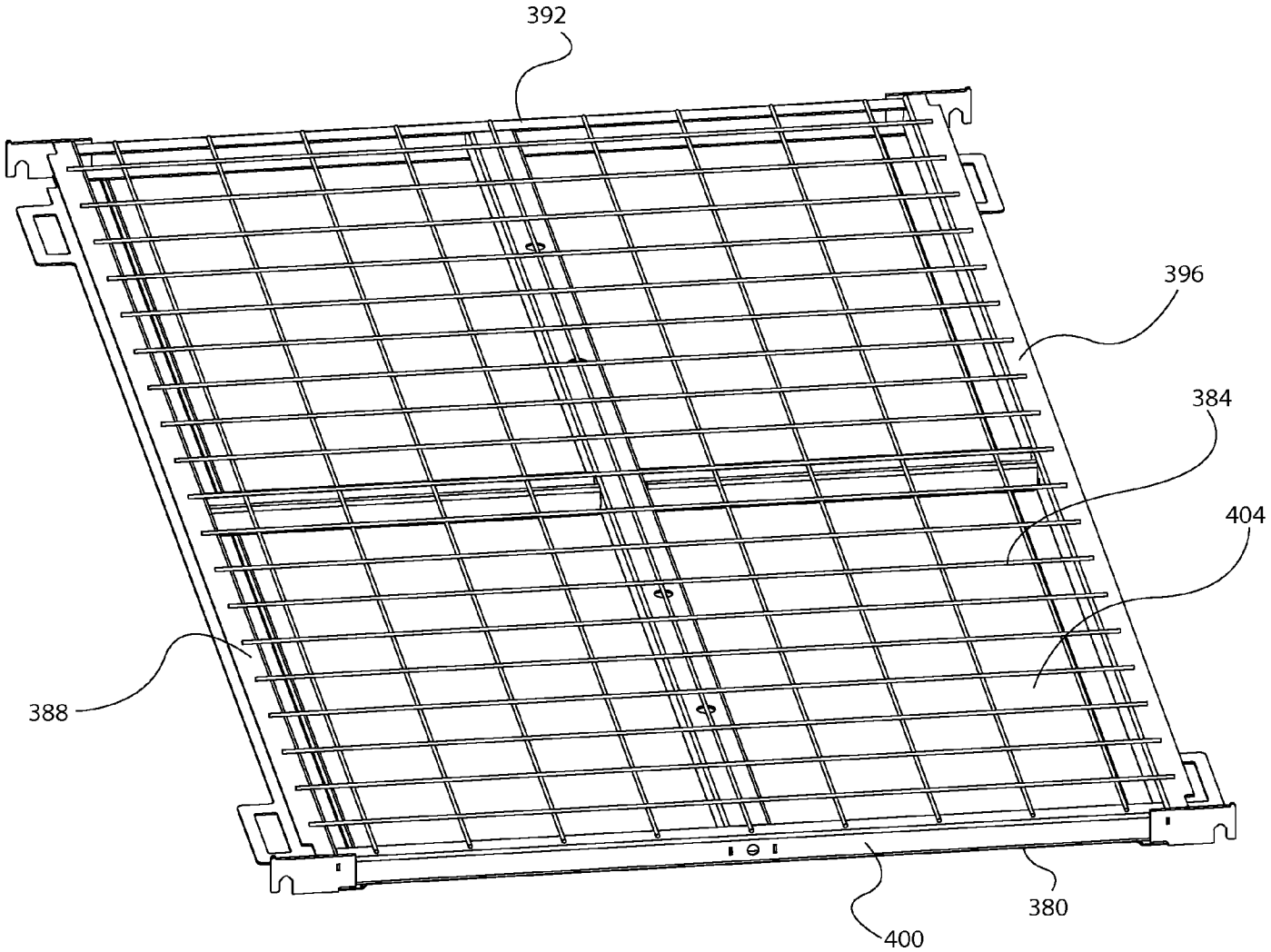
FIG. 36 is another view of the liquid barrier shelf.

FIG. 36 is another view of the liquid barrier shelf 380.

Figure 37:
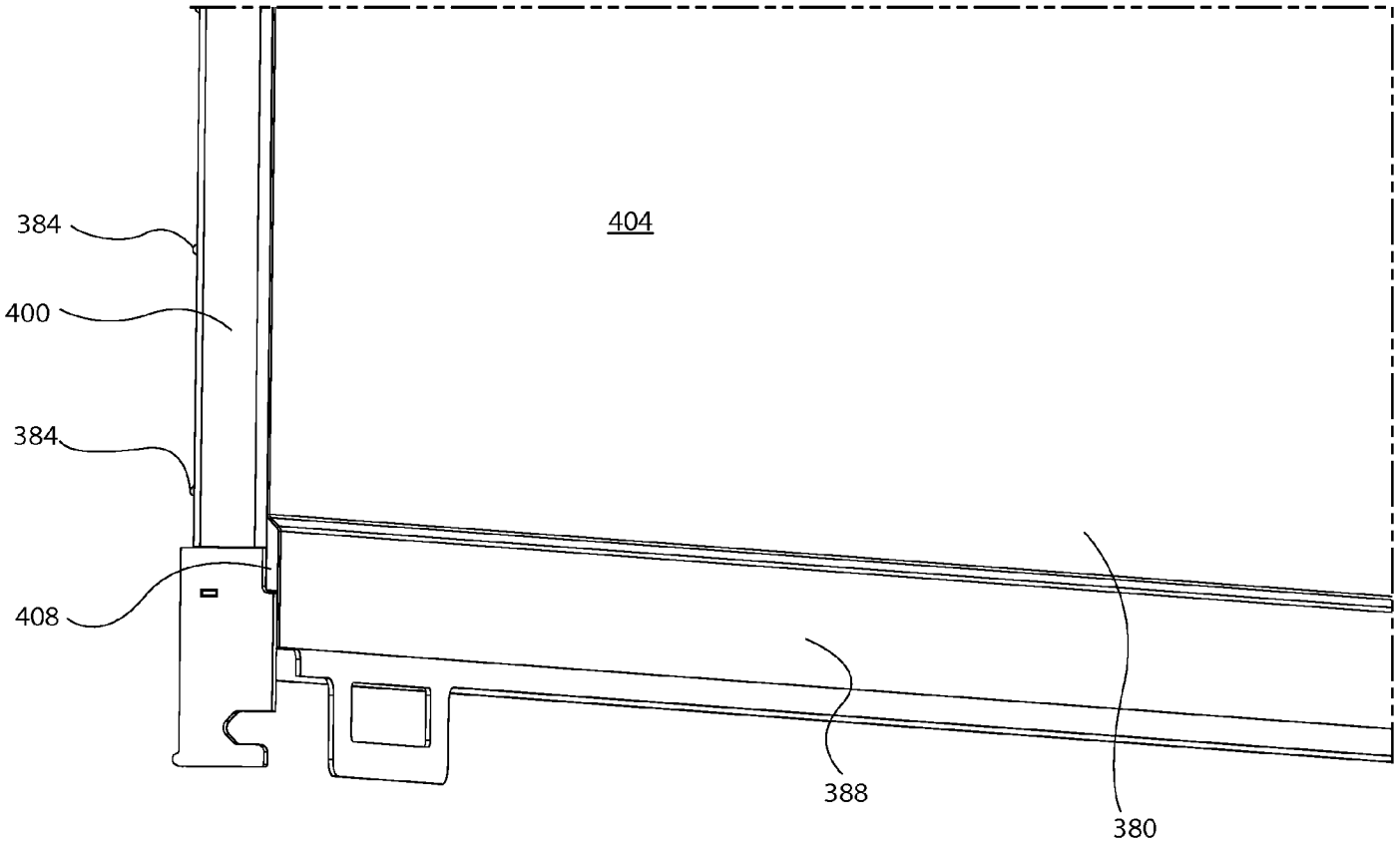
FIG. 37 is a view of the underside of a liquid barrier shelf.

FIG. 37 is a view of the underside of a liquid barrier shelf 380. The grid 384 can just be seen on the left side of the shelf 380. Visible in this view is a drain hole 408 located in the front beam 388. The drain hole configured to drain liquid collected on the top surface of liquid barrier plate 404 and direct the liquid down the second side panel 400. There may also be a drain hole 408 on the other end of the front beam 388, where liquid draining out of that hole 408 will generally drain down the first side panel 392. In addition, there may similarly configured drain holes on the rear beam 396.

Figure 38:
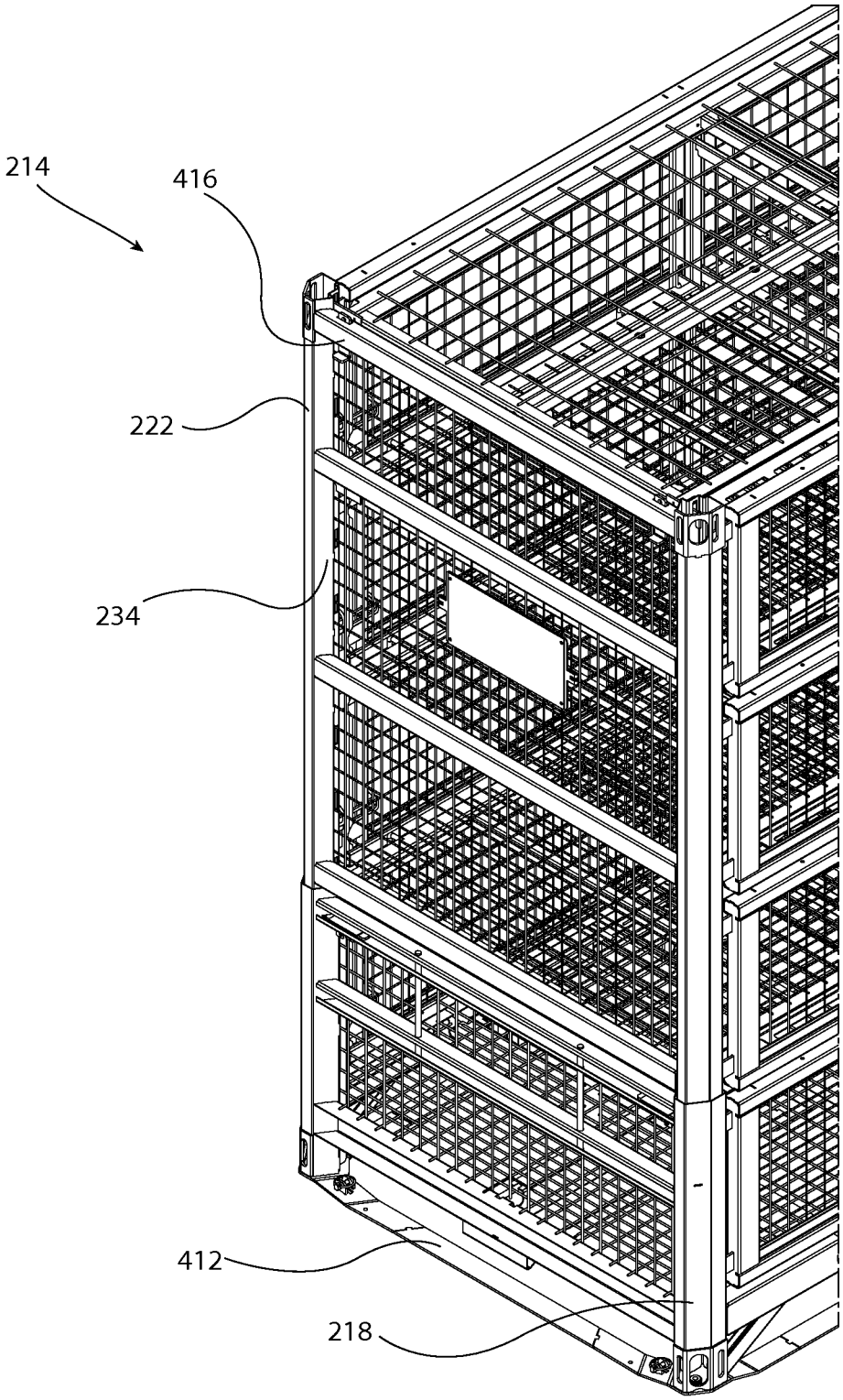
FIG. 38 is a perspective close up view of a first side panel.
Figure 39:
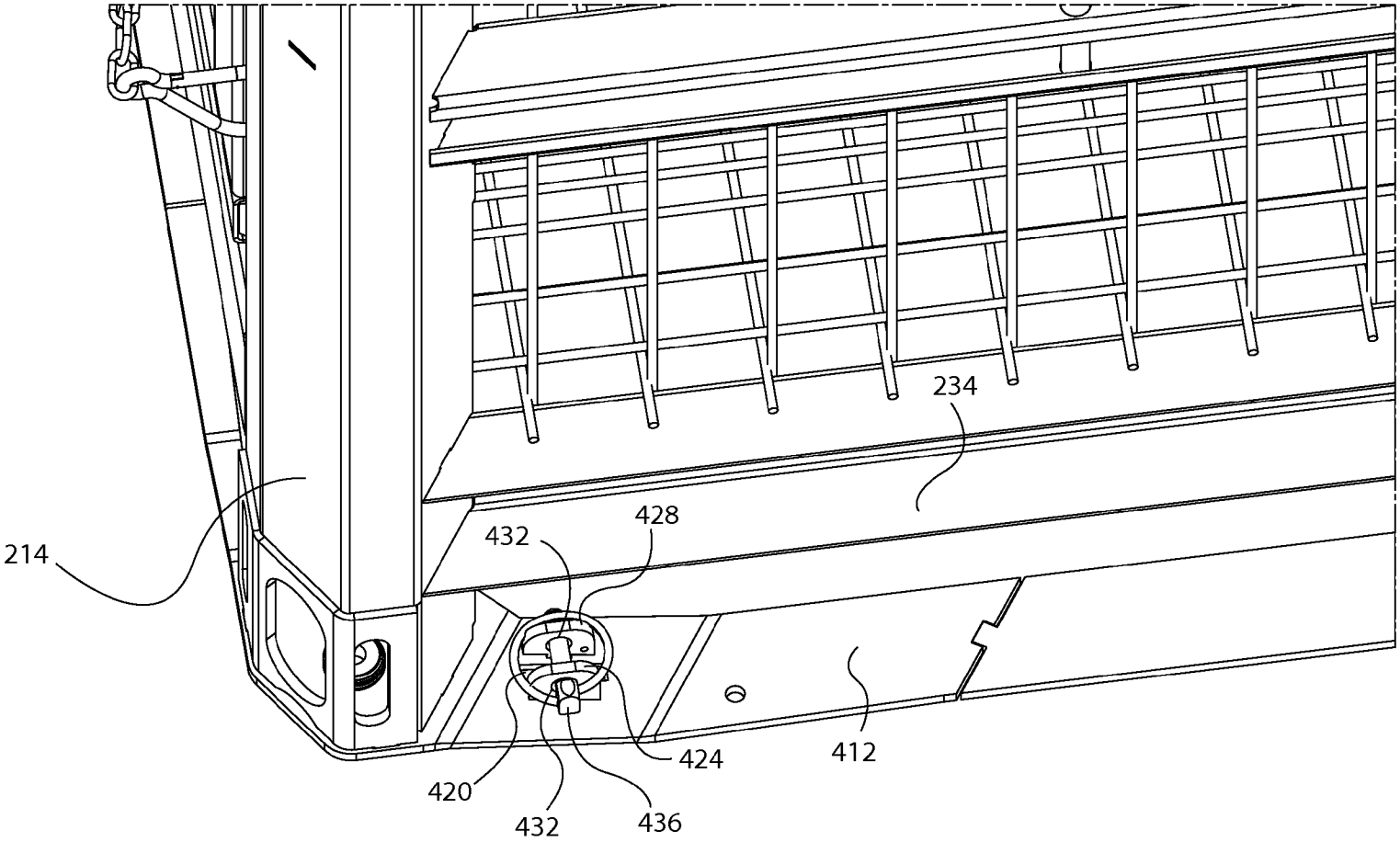
FIG. 39 is a close up view of the first bottom support member.

FIG. 38 is a perspective close up view of a first side panel 234 of an intermodal container 214. Shown in this figure is a first bottom support member 412 attached to the first and second posts 218, 222, and located generally at the bottom of the intermodal container 214. The first side panel 234 comprises a top beam 416 attached to the first and second posts 218, 222, and located generally at the top of the intermodal container 214. FIG. 39 is a close up view of the first bottom support member 412. In this view one can see that the first bottom support member 412 comprises a first slot 420, and a first tab 424 that extends generally upwards and vertically from the first bottom support member 412, and located on one side of the slot 420. In this embodiment there is a second tab 428 that extends generally upwards and vertically from the first bottom support member 412, and is located on the other side of the slot 420. However, in another embodiment, there may be only a single tab associated with a slot 420. In both tabs 424, 428 there are pin holes 432 with a pin 436 going through both tabs 424, 428. Not visible in this view, there may be a second bottom support member attached to the third and fourth posts 226, 230, and located generally at the bottom of the intermodal container. The second bottom support member may have a similar configuration slots, tabs, pin holes and pins.

Figure 40:
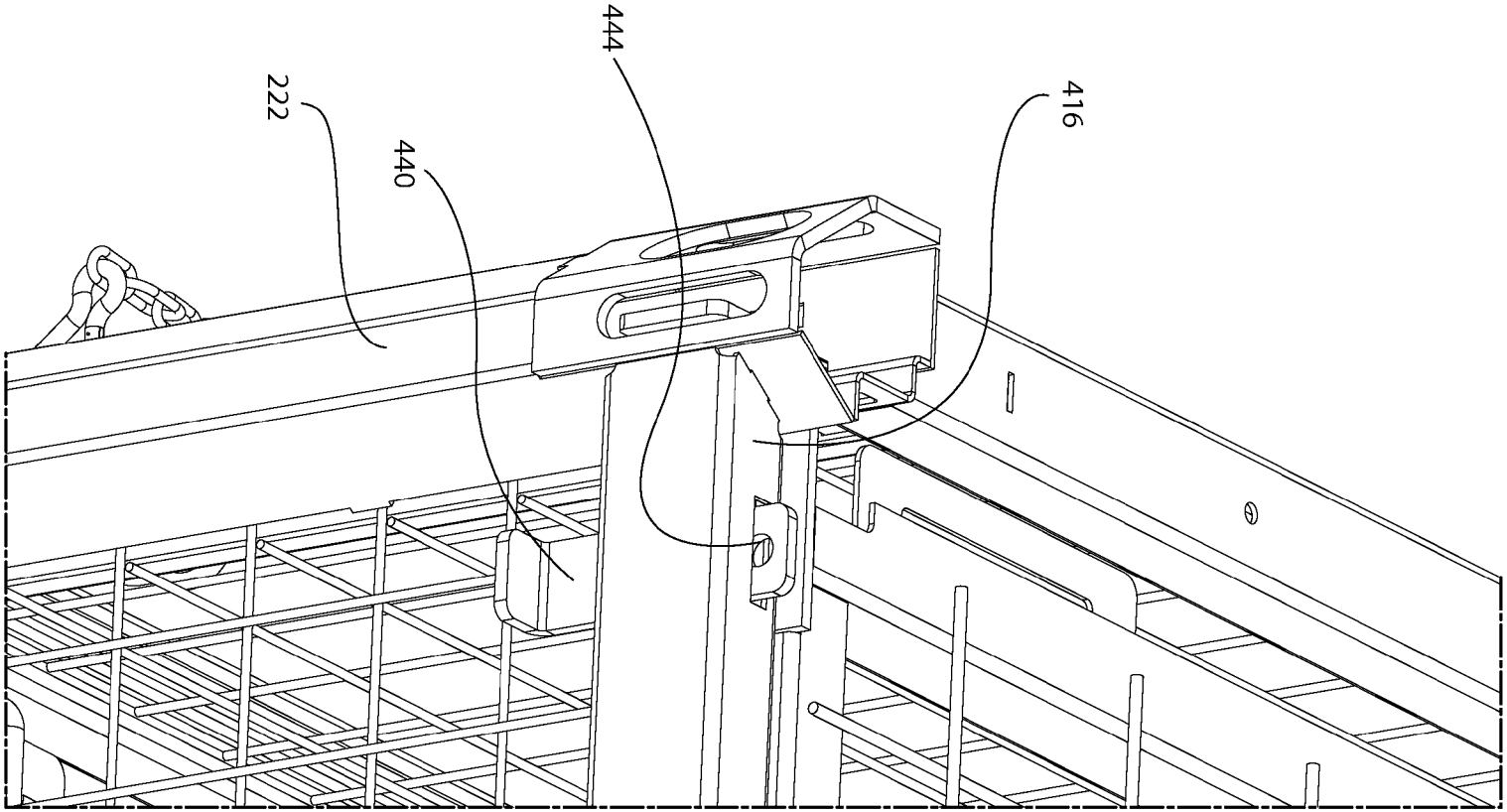
FIG. 40 is a close up view of the top beam.

FIG. 40 is a close up view of the top beam 416. The top beam 416 comprises a first sliding bar 440 slideably attached to the top beam 416. The first sliding bar 440 is slideable in generally a vertical direction with respect to the top beam, and the first sliding bar 440 is generally parallel with the posts. The first sliding bar 440 has a pin hole 444 located generally near the top of the first sliding bar 440.

Figure 41:
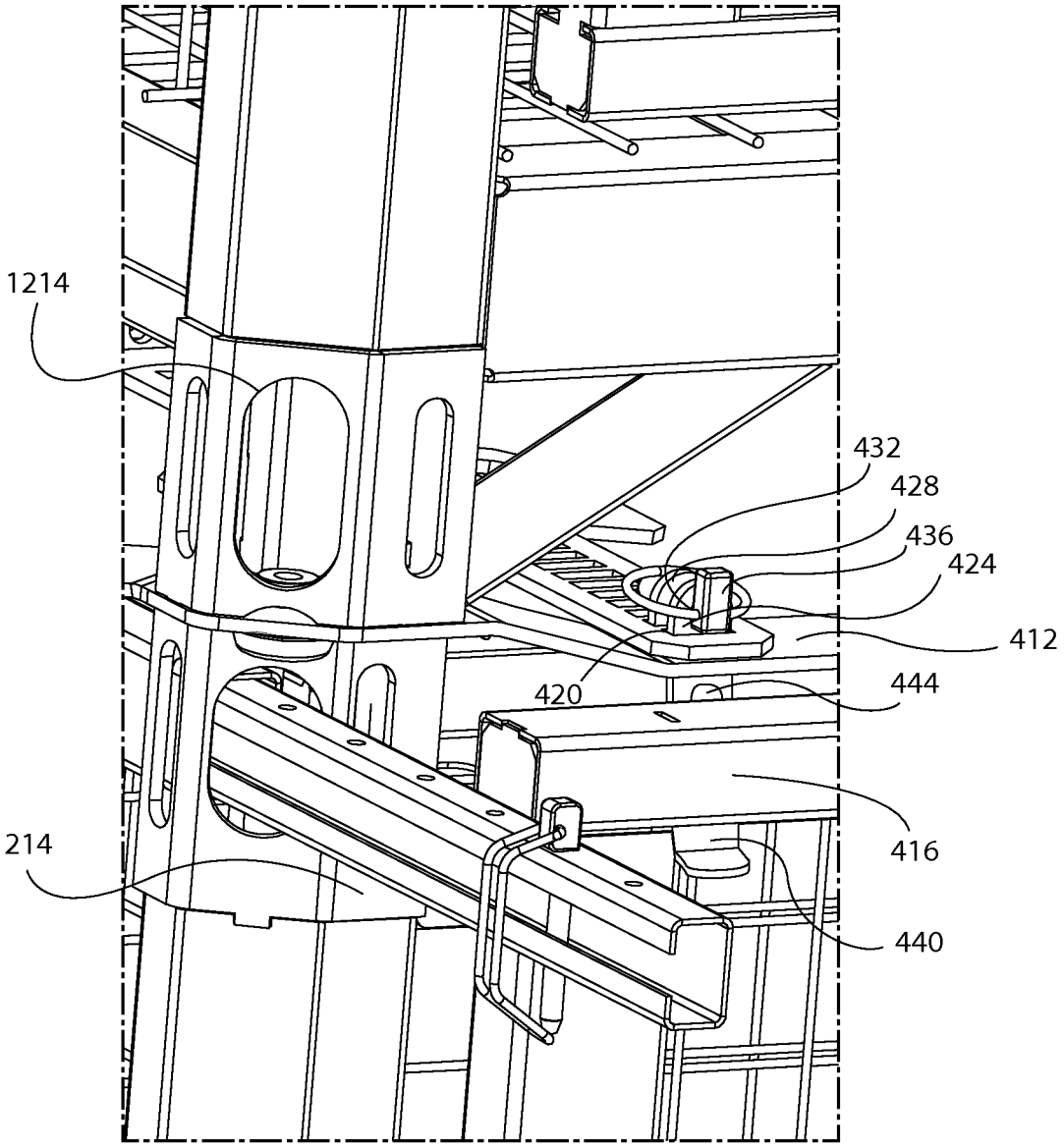
FIG. 41 shows a close up view of the sliding bar system on a first intermodal container that has a second intermodal container stacked on top of it.

FIG. 41 shows a close up view of the sliding bar system on a first intermodal container 214 that has a second intermodal container 1214 stacked on top of it. The second intermodal container 1214 is generally identical to the first intermodal container 214. In this figure, one can see how the sliding bar system can be used to secure two stacked intermodal containers 214, 1214 together. One can see that the sliding bar 440 can be slid up through the slot 420 in the upper intermodal container 1214 and the pin 436 can be withdrawn to allow the bar to slide up such that the pin hole 444 of the sliding bar 440 will line up with the pin holes 432 of the tabs 424, 428, and then the pin 436 can be reinserted into all three pin holes, thus securing the top intermodal container 1214 to the bottom intermodal container 214. Of course, one of ordinary skill will recognize that there may be more than one sliding bar system on each intermodal container. The second side panel may easily be configured to have one or more sliding bar systems. One of ordinary skill will recognize that the sliding bar may be held in place without any tabs, or with only one tab.

This invention has many advantages. There is no requirement for tools to assemble, disassemble or operate the disclosed intermodal container. There is no other known system that incorporates shock dampening or self centering corners for stacking of the intermodal containers. The disclosed intermodal containers are the lightest containers available with the strength capabilities it possesses. Bracing and blocking members are integral to the container. The panels and shelving can be locked in place, preventing theft of the material being shipped. The intermodal containers efficiently use a great majority of the volume available in various shipping means.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An intermodal container comprising:

a first post;

a first side panel attached to the first post;

a second post, attached to the first side panel;

a third post;

a second side panel attached to the third post;

a fourth post attached to the second side panel;

a front panel attached to the first and fourth posts;

a rear panel attached to the second and third posts;

at least one shelf attached to the first, second, third, and fourth posts, and where the at least one shelf can attach to the posts at a plurality of heights along the posts;

a front floor beam attached to the first and fourth posts, the front floor beam having a generally uniform cross-section consisting generally of a single material;

a rear floor beam attached to the second and third posts, the rear floor beam having a generally uniform cross-section consisting generally of a single material;

at least one cross beam attached to the front floor beam and rear floor beam, the at least one cross beam having a generally uniform cross-section consisting generally of a single material, and the at least one cross beam having a length that is the longest dimension of the cross beam;

a first floor beam notch located on the front floor beam, the first floor beam notch having a length that is the longest dimension of the first floor beam notch, with the first floor beam notch length generally collinear with the cross beam length;

a first cross beam notch located on the at least one cross beam, the first cross beam notch generally located on a front floor beam end of the at least one cross beam, the first cross beam notch having a length that is the longest dimension of the first cross beam notch with the first cross beam notch length generally collinear with the cross beam length;

a first cut-out located in the at least one cross beam, the first cut-out forming a first gap located between the at least one cross beam and the front floor beam;

a first bar attached to the first floor beam notch and the first cross beam notch, and traversing the first gap, the first bar generally collinear with the first floor beam notch length, the first cross beam notch length, and the cross beam length;

a second floor beam notch located on the rear floor beam, the second floor beam notch having a length that is the longest dimension of the second floor beam notch, with the second floor beam notch length generally collinear with the cross beam length;

a second cross beam notch located on the at least one cross beam, the second cross beam notch generally located on a rear floor beam end of the at least one cross beam, the second cross beam notch having a length that is the longest dimension of the second cross beam notch, with the second cross beam notch length generally collinear with the cross beam length;

a second cut-out located in the cross beam, the cut-out forming a second gap located between the at least one cross beam and the rear floor beam;

a second bar attached to the second floor beam notch and the second cross beam notch, and traversing the second gap, the second bar generally collinear with the second floor beam notch length, the second cross beam notch length, and the cross beam length;

wherein the first gap is configured to allow a strap to slide through the first gap and wrap around the first bar and is further configured to allow a hook to slide through the first gap and hook onto the first bar; and wherein the second gap is configured to allow a strap to slide through the second gap and wrap around the second bar and is further configured to allow a hook to slide through the second gap and hook onto the second bar.

2. The intermodal container of claim 1, wherein the first bar and second bar are generally cylindrical in shape.

3. The intermodal container of claim 1, wherein the first floor beam notch is generally located on a top surface of the front floor beam, and traverses the entire width of the floor beam, and has a depth of approximately ¾ of the cross-sectional height of the first bar.

4. The intermodal container of claim 1, where in the first cut-out is shaped such that a horizontal surface of the at least one cross beam does not extend all the way to the front floor beam but stops short approximately a distance slightly less than the length of the first bar, and the first cut-out is also shaped such that the first cross beam notch is formed in a vertical surface of the at least one cross beam such that the notch is adjacent to the front floor beam.

* * * * *